US007122225B2

(12) United States Patent
Ohbayashi et al.

(10) Patent No.: US 7,122,225 B2
(45) Date of Patent: Oct. 17, 2006

(54) METHOD FOR PREPARING AN INK-JET RECORDING SHEET WITH A CONSTANT AND A FALLING DRYING RATE

(75) Inventors: Keiji Ohbayashi, Tokyo (JP); Atsushi Saito, Tokyo (JP); Yuichiro Maehara, Tokyo (JP); Yoshinori Tsubaki, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/773,371

(22) Filed: Feb. 6, 2004

(65) Prior Publication Data

US 2004/0157009 A1 Aug. 12, 2004

Related U.S. Application Data

(62) Division of application No. 10/085,566, filed on Feb. 27, 2002, now abandoned.

(30) Foreign Application Priority Data

Mar. 9, 2001 (JP) ..... 2001-066421
Dec. 12, 2001 (JP) ..... 2001-378510

(51) Int. Cl.
*B05D 1/38* (2006.01)

(52) U.S. Cl. ..... 427/411; 427/412.1

(58) Field of Classification Search ..... 427/144, 427/411–412.5, 414
See application file for complete search history.

(56) References Cited

U.S. PATENT DOCUMENTS

| | | | | |
|---|---|---|---|---|
| 4,732,786 | A * | 3/1988 | Patterson et al. | 427/261 |
| 5,612,281 | A * | 3/1997 | Kobayashi et al. | 428/32.11 |
| 6,197,381 | B1 * | 3/2001 | Saito et al. | 427/374.3 |
| 6,335,102 | B1 | 1/2002 | Tsubaki et al. | |
| 6,387,473 | B1 | 5/2002 | Sismondi et al. | |
| 6,436,515 | B1 | 8/2002 | Ohbayashi et al. | |
| 6,492,005 | B1 | 12/2002 | Ohbayashi et al. | |
| 6,582,802 | B1 * | 6/2003 | Ohbayashi et al. | 428/206 |
| 6,613,419 | B1 | 9/2003 | Ohbayashi | |
| 6,620,470 | B1 | 9/2003 | Nojima et al. | |
| 6,685,999 | B1 * | 2/2004 | Ichinose et al. | 428/32.25 |

OTHER PUBLICATIONS

Modern Coating and drying Technology, 1992, 274-277.*

* cited by examiner

*Primary Examiner*—Fred J. Parker
(74) *Attorney, Agent, or Firm*—Frishauf, Holtz, Goodman & Chick, P.C.

(57) ABSTRACT

An ink-jet recording sheet comprising a substrate having thereon a porous layer formed by a process comprising the steps of:

(a) coating on the substrate an aqueous coating composition containing a hydrophilic binder and inorganic particles to form the porous layer;

(b) drying the porous layer over a period, wherein the period comprises at least a constant drying rate period and a falling drying rate period; and (c) incorporating a solution containing an additive into the porous layer after the completion of the constant drying rate period.

15 Claims, No Drawings

METHOD FOR PREPARING AN INK-JET RECORDING SHEET WITH A CONSTANT AND A FALLING DRYING RATE

This is a divisional application of Ser. No. 10/085,566, filed Feb. 27, 2002 (Abandoned).

FIELD OF THE INVENTION

The present invention relates to an ink-jet recording sheet (hereinafter occasionally referred to as a recording sheet) and in more detail to an ink-jet recording sheet comprising a porous layer, which minimizes cracking and improves a variety of demanded performance. The present invention also relates to a production method of the ink-jet recording sheet having the above-mentioned properties.

BACKGROUND OF THE INVENTION

In recent years, in ink-jet recording systems, image quality has increasingly been improved so as to approach the conventional silver salt photographic images. As a means to achieve conventional photographic image quality utilizing ink-jet recording, employed recording sheets are those which have been under rapid technical improvements. For example, recording sheets have been developed which comprise a highly smoothed substrate having thereon a porous layer comprising minute ink absorptive voids. Since said sheet exhibits high ink absorbability as well as excellent drying properties, its use has become one of the methods to generate images which are most similar to said photographic quality.

Said porous ink layer is comprised mainly of hydrophilic binders as well as fine particles. Known as such fine particles are fine inorganic or organic particles, however, fine inorganic particles with higher gloss, capable of decreasing the particle size, are generally employed.

On the other hand, regarding said substrates, known as ink-jet recording sheets are water absorptive substrates such as papers, as well as non-water absorptive substrates such as polyester films and resin coated papers. The former exhibits an advantage in relatively high ink absorbability due to its capability of absorbing ink. However, contrary to said advantage, it exhibits disadvantages as described below. Problems occur in which creases (also called cockling) after printing tend to form due to the water absorbability of said substrate. As a result, it is difficult to produce high quality prints, and the print surface tends to rub the head due to said creasing during printing.

On the contrary, the use of said non-water absorptive substrates exhibits advantages such that none of the problems described above occur and high quality prints are produced. However, the ink absorption amount is limited.

Generally, various characteristics are required for said ink absorptive layer. As a result, in order to improve said various characteristics, the use of each additive, described below, is proposed:

1: fine stable particles to result in voids of no more than approximately 0.1 μm to achieve high color forming capability as well as high gloss 2: low swellable hydrophilic binders to increase fine particle holding force as well as to minimize a decrease in the ink absorption rate 3: cross-linking agents of hydrophilic binders to enhance the ink absorption rate as well as the waterfastness of coated layers 4: surface active agents and hydrophilic polymers distributed over the surface to achieve an optimal dot diameter 5: cationic fixing agents to minimize bleeding of dyes as well as to improve the waterfastness of said dyes 6: anti-discoloring agents to minimize the discoloration of dye images due to light as well as oxidizing gases 7: optical brightening agents as well as color control agents (such as reddening agents and bluing agents) to improve white backgrounds 8: matting agents as well as slipping agents to control the slipping properties of the surface 9: various types of oil components, latex particles and water-soluble plasticizers to provide desired flexibility to coated layers 10: various inorganic salts (multivalent metal salts) to minimize the bleeding of dyes as well as to enhance the waterfastness and weather fastness of dyes 11: acids and alkalis to adjust the pH of porous layers.

However, when additives, which are employed to achieve the various purposes as described above, are added to an ink receptive layer forming coating composition, many additives are frequently subjected to various limitations from the viewpoint of stabilizing the production processes.

Production beyond said limitations may cause problems which include: for example, A: When coagulation occurs among fine particles or among additives, or when phase separation occurs in a coating composition, problems occur which make it difficult to achieve stable uniform coating; gloss decreases to result in a matt surface; and production efficiency markedly decreases due to a decrease in the pot life of the coating composition.

B: When a prepared coating composition is kept standing over an extended period of time, said composition may markedly increase its viscosity to result in gelling or on the contrary, it may decrease its viscosity so that it tends to flow too easily on the substrate. As a result, it becomes difficult to achieve stable coating, making it difficult to obtain a uniform coating.

C: When a porous layer is coated and subsequently dried, surface cracking tends to occur.

D: The void ratio in the porous layer decreases.

Problems, which relate to items A and B, frequently occur mainly due to electrical and mutual interaction of additives. For example, cationic fixing agents may play a major role while reacting with raw materials having an anionic group so as to result in various problems.

On the other hand, problems, which relate to items C and D, occur mainly when a non-water absorptive substrate is employed as a substrate. Namely, in the case of an ink-jet recording sheet which comprises a non-water absorptive substrate having thereon a porous layer comprised of voids, it is required that during ink-jet recording, all the ink is temporarily held in the void layer as the ink absorptive layer. In order to achieve this, it is required that said ink-jet recording sheet have a large void volume. As a result, it is required that a thick-coated layer having a high void ratio be formed.

When said porous layer is applied onto said non-ink absorptive layer, it is required that the dried layer thickness is generally at least 25 μm, and is more preferably from 30 to 50 μm. When such a relatively thick porous layer is applied onto a substrate, problems occur during the production period, in which cracking tends to occur during drying due to the fact that said porous layer is stiff, or the void ratio decreases. Particularly, when various additives, to achieve various functions, are added to the porous layer forming coating composition, said adverse problems are more exhibited.

It is assumed that cracking of said porous layer is due to the contraction of the coating during drying and depends on various factors. As one of these factors, it is assumed that the presence of additives, which decrease the holding ability of fine particles in the hydrophilic binder, tends to result in said cracking.

Further, the void ratio tends to increase through the interaction between fine particles or between hydrophilic binders. However, said interaction may decrease upon employing a certain type of additive, whereby said void ratio occasionally decreases. Namely, each of fine particles tends to be subjected to closest packing.

Generally, at present, the usable ratio of hydrophilic binders to fine particles is limited to no more than 1/2 in terms of weight ratio, and specifically no more than 1/3, so that the ink absorbability does not decrease, while voids, which generate porosity, are filled. As a result, the ability of said hydrophilic binders to protect fine colloidal particle tends to be affected by a small amount of additives.

During the drying process of a porous layer, said porous layer is formed in such a manner that while a small amount of binder is covering the surface of fine particles, said binder, which is entwined with each other, protect colloidal fine particles. However, during said process, if additives are present, said binders are not sufficiently entwined with each other. Therefore, it is assumed that the resulting layer strength decreases and cracking tends to occur during the period in which the layer is subjected to contraction during the drying process, especially during the period in which drying is almost completed.

Usually, ink-jet recording sheets are produced by applying a porous layer forming coating composition onto a continuously conveyed substrate, and subsequently winding the resulting coating into a roll after drying. Thereafter, a coating composition comprised of specified additives is applied onto the surface of said coating. This is known as a so-called overcoat applying method (hereinafter referred to as an overcoating method). However, since in most of said overcoating methods, coating is carried out while divided into at least two time frames, problems occur resulting in markedly increased production cost. Further, other problems tend to occur in which quality consistency is degraded due to the temperature history as well as time fluctuation during temporary storage after the formation of said porous layer and in addition, non-uniform coating tends to occur during said overcoating.

Generally, the layer state just after coating and drying is often different from its state after storage, depending on the existing state of the hydrophilic binders, the ongoing crystallization, and the re-orientation of the distribution of additives in the layer.

It is assumed that immediately after coating and drying, said hydrophilic binders are distributed nearly equal to their solution state. However, when they are stored and subjected to an equilibrium state, the swellability of the resulting layer tends to decrease due to the interaction (being the cross-linking reaction) between the fine particles and the additives. Specifically, polyvinyl alcohol, which is most useful as a hydrophilic binder, often results in variation of water absorbability of the overcoated composition as well as swellability with respect to the hydrophilic binders.

Further, surface active agents, hydrophilic binders, and other diffusible additives on the surface of said porous layer tend to be gradually modified after being coated, so as to adversely affect the wettability of said overcoating composition. As a result, during coating of said overcoating composition, non-uniform coating tends to occur.

Still further, variation of said porous layer during its storage period results in difference in the distribution of overcoated additives in said layer, as well as differences in their effects. As a result, said variation may become a fluctuation factor to result in the resulting product quality.

A method, in which an additive containing coating composition is applied onto said porous layer so as to supply additives to said porous layer, is known as a so-called impregnation method when ink-jet recording sheets are produced. However, no method at all is known in which, just after forming said porous layer, the production is carried out utilizing an on-line means.

Japanese Patent Publication Open to Public Inspection No. 11-115308 describes a method in which a coating composition, comprising fine inorganic particles as well as a water-soluble resin, is applied onto a substrate and at the same time of coating or before the coated layer reaches falling drying rate, said coated layer is hardened by providing a solution comprising a cross-linking agent of said water-soluble resin. "Before the coated layer reaches falling drying rate", as described herein, refers to a constant drying rate period, as described in said patent, and the drying period in which the content of solvents in the coating decreases in proportion to time when fixed drying conditions are maintained.

However, investigations conducted by the inventors of the present invention revealed that problems generally occurred at high speed coating as described below. When said additives are overcoated during the constant drying rate period, the solvents of the preceding coating composition are not sufficiently evaporated. As a result, cracking occurs in the final period of drying, or at the time when the overcoating is carried out, the surface of the applied overcoating composition is subjected to a drying airflow as well as mechanical vibration. As a result, airflow unevenness, that is, coating unevenness due to variation of airflow which hits said surface, as well as transporting unevenness, tends to occur.

Japanese Patent Publication Open to Public Inspection No. 8-34160 describes a method in which a solution, comprising a silane coupling agent having a quaternary ammonium salt group, is overcoated onto the surface of a layer comprised of fine inorganic particles and a water-soluble resin. However, in the method claimed in said patent, a solution comprising an additive is overcoated onto the surface of a porous layer which has been obtained by drying, and further said patent describes neither the formation of a porous layer targeted by the present invention nor the coating of a solution utilizing an on-line means. Said patent depends on a conventional and common method, whereby problems with said coating unevenness and insufficient quality stability are not overcome.

Accordingly, a first object of the present invention is to provide an ink-jet recording sheet which comprises a substrate having thereon a porous layer having a high void ratio, which minimizes the formation of cracking during production, even though various additives are incorporated in said porous layer comprised of hydrophilic binders as well as fine particles. A second object of the present invention is to provide an ink-jet recording sheet which exhibits high quality without a marked increase in production cost when a solution comprising additives is overcoated after applying a coating composition forming a porous layer onto a substrate. A third object of the present invention is to provide a high quality ink-jet recording sheet in which the fluctuation of manufacturing quality is minimized and coating uniformity is improved.

SUMMARY OF THE INVENTION

The aforesaid objects of the present invention were achieved utilizing the embodiments described below.

(1) An ink-jet recording sheet comprising a substrate having thereon a porous layer formed by a process comprising the steps of:

(a) coating on the substrate an aqueous coating composition containing a hydrophilic binder and inorganic particles to form the porous layer;

(b) drying the porous layer over a period, wherein the period comprises at least a constant drying rate period and a falling drying rate period; and (c) incorporating a solution containing an additive into the porous layer after the completion of the constant drying rate period.

(1-2) The ink-jet recording sheet of item (1), wherein the incorporation of the solution containing an additive into the porous layer is carried out before a drying end point.

(1-3) The ink-jet recording sheet of item (1-2), wherein the incorporation of the solution containing an additive into the porous layer is carried out in the same coating line used for coating the aqueous coating composition to form the porous layer after the moment when the volume content of water in the porous layer is less than the void volume of the porous layer at a drying end point.

(2) The ink-jet recording sheet of item (1), wherein the incorporation of the solution containing an additive into the porous layer is carried out at the moment when the following formula is satisfied:

$$Vwp+Vs \leqq 1.5\ Vvp,$$

wherein Vwp is the volume content of water in the porous layer, Vs is the volume of the solution containing an additive and Vvp is the void volume of the porous layer at a drying end point.

(3) The ink-jet recording sheet of item (1), wherein the solution containing an additive comprises water or a mixture of water and an organic solvent which is miscible with water.

(4) The ink-jet recording sheet of item (1), wherein the ink-jet recording sheet is wound in a roll after the step (c) without substantially being dried.

(5) The ink-jet recording sheet of item (1), wherein the substrate is a resin coated paper comprising paper covered with a polyolefin resin on both sides of the paper.

(6) The ink-jet recording sheet of item (5), wherein the content of water in the paper is at most 8 weight % of the paper.

(7) The ink-jet recording sheet of item (5), wherein the incorporation of the solution containing an additive into the porous layer is carried out at the moment when the following formula is satisfied:

$$Mwp+Mws \leqq 0.07\ Mp,$$

wherein Mwp is the weight content of water in the porous layer, Mws is the weight content of water in the solution containing an additive, and Mp is the weight of the paper used for the substrate.

(8) The ink-jet recording sheet of item (1), wherein the additive in the solution is a surface active agent.

(9) The ink-jet recording sheet of item (1), wherein the viscosity of the solution containing an additive is at most 100 mPa·s.

(10) The ink-jet recording sheet of item (1), wherein the additive in the solution is a hardener for the hydrophilic binder.

(11) The ink-jet recording sheet of item (1), wherein the additive in the solution is an image stabilizer.

(12) The ink-jet recording sheet of item (1), wherein the additive in the solution is a water-soluble polyvalent metal compound.

(13) The ink-jet recording sheet of item (1), wherein the pH value of the solution containing an additive is from 1 to 5.

(14) The ink-jet recording sheet of item (1), wherein the pH value of the solution containing an additive is from 8 to 13.

(15) A method for preparing an ink-jet recording sheet, comprising the steps of:

(a) coating on the substrate an aqueous coating composition containing a hydrophilic binder and inorganic particles to form the porous layer;

(b) drying the porous layer over a period, wherein the period comprises at least a constant drying rate period and a falling drying rate period; and (c) incorporating a solution containing an additive into the porous layer after the completion of the constant drying rate period.

(16) The method for preparing the ink-jet recording sheet of item (15), wherein the incorporation of the solution containing an additive into the porous layer is carried out before the drying end point.

(17) The method for preparing the ink-jet recording sheet of item (15), wherein the incorporation of the solution containing an additive into the porous layer is carried out in the same coating line used for coating the aqueous coating composition to form the porous layer.

(18) The method for preparing the ink-jet recording sheet of item (15), wherein the incorporation of the solution containing an additive on the porous layer is carried out at the moment when the following formula is satisfied:

$$Vwp+Vs \leqq 1.5\ Vvp,$$

wherein Vwp is the volume content of water in the porous layer, Vs is the volume of the solution containing an additive and Vvp is the void volume of the porous layer at the time of the drying end point.

(19) The method for preparing the ink-jet recording sheet of item (15), wherein the solution containing an additive comprises water or a mixture of water and an organic solvent which is miscible with water.

(20) The method for preparing the ink-jet recording sheet of item (15), wherein the ink-jet recording sheet is wound in a roll after the step (c) without substantially drying.

(21) The method for preparing the ink-jet recording sheet of item (15), wherein the substrate is a resin coated paper comprising paper covered with a polyolefin resin on both sides of the paper.

(22) The method for preparing the ink-jet recording sheet of item (21), wherein the content of water in the paper is at most 8 weight % of the paper.

(23) The method for preparing the ink-jet recording sheet of item (21), wherein the incorporation of the solution containing an additive on the porous layer is carried out at the moment when the following formula is satisfied:

$$Mwp+Mws \leqq 0.07\ Mp,$$

wherein Mwp is the weight content of water in the porous layer, Mws is the weight content of water in the solution containing an additive, and Mp is the weight of the paper used for the substrate.

(24) The method for preparing the ink-jet recording sheet of item (15), wherein the additive in the solution is a surface active agent.

(25) The method for preparing the ink-jet recording sheet of item (15), wherein the viscosity of the solution containing an additive is at most 100 mPa·s.

(26) The method for preparing the ink-jet recording sheet of item (15), wherein the additive of the solution is a hardener for the hydrophilic binder.

(27) The method for preparing the ink-jet recording sheet of item (15), wherein the additive in the solution is an image stabilizer.

(28) The method for preparing the ink-jet recording sheet of item (15), wherein the additive in the solution is a water-soluble polyvalent metal compound.

(29) The method for preparing the ink-jet recording sheet of item (15), wherein the pH value of the solution containing an additive is from 1 to 5.

(30) The method for preparing the ink-jet recording sheet of item (15), wherein the pH value of the solution containing an additive is from 8 to 13.

The inventors of the present invention performed investigations to solve said various problems. As a result, it was discovered that the problem with the formation of cracking of the porous layer after coating and drying could be solved in such a manner that, after forming a porous layer by applying onto a substrate a coating composition which did not comprise any additives which adversely affect said coating composition as well the resulting coated layer and subsequently dried, the resulting porous layer was overcoated with a solution comprising additives at a specific period of drying step. This method made it possible to overcome the problems described above.

DETAILED DESCRIPTION OF THE INVENTION

The ink-jet recording sheet of the present invention is characterized in that said ink-jet recording sheet is prepared by applying onto a substrate a water-soluble coating composition comprising a hydrophilic binder and fine particles which forms a porous layer, and then the porous layer is subjected to drying. The drying step comprises a constant drying rate followed by a falling drying rate. After the completion of the constant drying rate, i.e. after starting the falling drying rate, a solution containing an additive is applied into said porous layer. The ink-jet recording sheet of the present invention is characterized in that the solution containing an additive is applied into a porous layer before the drying end point.

The falling drying rate period and the drying end point, specified in the present invention, will now be described.

A process for coating the additive containing solution according to the present invention is carried out after the drying process to dry the wet coating (being the porous layer), which has been prepared by applying a water-soluble porous later coating composition comprising a hydrophilic binder as well as fine particles, onto a substrate.

In a drying process, a wet state coating, which is continuously conveyed, is generally dried by blowing drying air controlled under conditions of specified temperature and humidity to the surface or the back of said coating.

The drying process of the wet coating can be classified mainly as described below. An initial drying period is called the constant drying rate period. Since an ink-jet recording sheet comprises a relative large amount of water and solvents during the initial drying period, the surface temperature of the side, having the porous layer, is kept almost constant due to the fact that relatively free water and solvents evaporate while deriving those of latent heat of vaporization. Said constant temperature period is called the constant drying rate period. Contrary to this, when water and solvents, which interact with hydrophilic binders, are evaporated, the surface temperature increase due to the fact that in addition to latent heat of vaporization, energy to release said interaction is required. Said period is called the falling drying rate period. Said falling drying rate period is formed based on phenomena in which the evaporation rate of water from the surface is greater than the movement rate of water in the coating in the layer. Void formation generally starts after entering the falling drying rate period in which water is further evaporated.

When the falling drying rate ends, a period starts in which the temperature of the drying airflow equals the surface temperature of the ink-jet recording sheet. This point is called the drying end point.

Methods for confirming the constant drying rate period, the falling drying rate period, and the drying end point, as described above, are not particularly limited. However, for example, the surface temperature of the side coated with the porous layer is measured. Then, it is possible to determine the constant drying rate period as a region in which said surface temperature is constant, the falling drying rate period as a region in which said surface temperature increases, and the drying end point as a point at which said surface temperature equals drying temperature.

Further, as another method, a water content meter is installed in each region, and the water content of the coating is measured. Then, each region can be specified based on the resultant water content decrease curve.

The present invention is characterized in that when an additive containing solution is coated, the total of the volume of water incorporated in the porous layer and the volume of the additive containing solution is no more than 1.5 times the void volume of said porous layer at the drying end point. However, said-total volume is preferably from 0.01 to 1.5 times.

The ink-jet recording sheet of the present invention will now be detailed.

In the ink-jet recording sheet of the present invention, a porous layer comprised of voids is prepared by applying onto a substrate a water-soluble coating composition which forms said porous layer comprising hydrophilic binders as well as fine particles.

The porous layer according to the present invention is formed employing fine inorganic particles and hydrophilic binders as major components.

Employed as fine particles usable in the present invention may be fine inorganic and organic particles. However, fine inorganic particles are particularly preferred, since high gloss as well as high color density is obtained, and in addition, fine particles are easily prepared. Listed as said inorganic particles may be, for example, white inorganic pigments such as precipitated calcium carbonate, heavy calcium carbonate, magnesium carbonate, kaolin, clay, talc, calcium sulfate, barium sulfate, titanium dioxide, zinc oxide, zinc hydroxide, zinc sulfide, zinc carbonate, hydrotalcite, aluminum silicate, diatomaceous earth, calcium silicate, magnesium silicate, synthetic non-crystalline silica, colloidal silica, alumina, colloidal alumina, pseudo-boehmite, aluminum hydroxide, lithopone, zeolite, and magnesium hydroxide. Primary particles of said fine inorganic particles may be employed without any further modification, and said inorganic particles may also be employed in the state in which secondary coagulated particles are formed.

In the present invention, from the viewpoint of preparing high quality prints utilizing ink-jet recording sheets, preferred as fine inorganic particles are alumina, pseudo-boehmite, colloidal silica, and fine silica particles synthesized employing a gas phase method of these, fine silica particles synthesized employing a gas phase method are particularly preferred. Said silica synthesized employing a gas phase method, whose surface is modified with aluminum may be employed. The content ratio of aluminum in the gas phase method silica whose surface is modified with aluminum is preferably from 0.05 to 5 percent by weight with respect to the total silica.

The diameter of said fine inorganic particles is not particularly limited, however, the average diameter is preferably no more than 1 μm. When said diameter exceeds 1 μm, the resulting glossiness as well as color forming properties tends to be degraded. Therefore, said diameter is more preferably no more than 0.2 μm, and is most preferably no more than 0.1 μm. The lower limit of said diameter is not particularly limited, however, from the viewpoint of producing said fine inorganic particles, said lower limit is preferably no less than approximately 0.003 μm, and is more preferably no more than 0.005 μm.

The average diameter of said fine inorganic particles is obtained as follows. The cross-section and surface of a porous layer are observed employing an electron microscope, and the diameter of 100 randomly selected particles is determined. Then, said average diameter is obtained as a simple average (being a number average), based on the obtained data. Herein, each particle diameter is the diameter of the circle which has the same area as the projection area of each particle.

Further, from the viewpoint of glossiness as well as color forming properties, the degree of dispersion of fine particles is preferably no more than 0.5. When said degree of dispersion exceeds 0.5, the resulting glossiness as well as color forming properties during printing tends to be degraded. Said degree of dispersion is most preferably no more than 0.3. The degree of dispersion of fine particles, as described herein, refers to the value obtained by dividing the standard deviation of the particle diameter by the average particle diameter which is determined by observing the fine particles of the porous layer in the same manner as for determining the aforesaid average particle diameter.

Said fine particles may be located in the porous layer in the form of primary particles which are not subjected to any modification, secondary particles, or higher order coagulated particles. However, said average particle diameter refers to the average diameter of particles which form independent particles in the porous layer when observed with an electron microscope.

The content of said fine particles in the water-soluble coating composition is preferably from 5 to 40 percent by weight, and is more preferably from 7 to 30 percent by weight.

Hydrophilic binders incorporated in the porous layer are not particularly limited, and any of those, which are conventionally known in the art, may be employed. For example, employed may be gelatin, polyvinylpyrrolidone, polyethylene oxide, polyacrylamide, and polyvinyl alcohol. Of these, polyvinyl alcohol is particularly preferred.

Polyvinyl alcohol exhibits an interaction with fine inorganic particles so as to result in a high holding force of fine inorganic particles. Further, polyvinyl alcohol is a polymer whose hygroscopic properties exhibit a relatively small dependence on humidity, and whose contraction stress during coating and drying is also relatively small. As a result, polyvinyl alcohol is excellent in minimizing cracking during coating and drying, which is the problem to be solved by the present invention. Polyvinyl alcohol preferably employed in the present invention includes common polyvinyl alcohol which is prepared by hydrolyzing polyvinyl acetate and also modified polyvinyl alcohol such as polyvinyl alcohol whose terminals have been subjected to cation modification and anion-modified polyvinyl alcohol having an anionic group.

The average degree of polymerization of said polyvinyl alcohol prepared by hydrolyzing vinyl acetate is preferably at least 300, and is more preferably from 1,000 to 5,000. The saponification ratio of said polyvinyl alcohol is preferably from 70 to 100 percent, and is more preferably from 80 to 99.5 percent.

Said cation-modified polyvinyl alcohol includes, for example, polyvinyl alcohol which has a primary, secondary or tertiary amino group, or a quaternary ammonium group in the main or side chain of said polyvinyl alcohol, as described in Japanese Patent Publication Open to Public Inspection No. 61-10483. Said polyvinyl alcohol is prepared by saponifying the copolymer of an ethylenic unsaturated monomer having a cationic group and vinyl acetate.

Listed as said ethylenic unsaturated monomers having a cationic group are, for example, trimethyl-(2-acrylamido-2,2-dimethylethyl)ammonium chloride, trimethyl-(3-acrylamido-3,3-dimethylpropyl)ammonium chloride, N-vinylimidazole, N-vinyl-2-methylimidazole, N-(3-dimethylaminopropyl)methacrylamide, hydroxyethyltrimethylammonium chloride, trimethyl-(-methacrylamidopropyl)ammonium chloride, and N-(1,2-dimethyl-3-dimethylaminopropyl)acrylamide.

The ratio of a cation-modified group containing monomers of cation-modified polyvinyl alcohol is from 0.1 to 10 mol percent, and is preferably from 0.2 to 5 mol percent.

Listed as said anion-modified polyvinyl alcohol are, for example, polyvinyl alcohol having an anionic group, described in Japanese Patent Publication Open to Public Inspection No. 1-206088, copolymers of vinyl alcohol and vinyl compounds having a water-solubilizing group, described in Japanese Patent Publication Open to Public Inspection Nos. 61-237681 and 63-307979, and modified polyvinyl alcohol having a water-solubilizing group, described in Japanese Patent Publication Open to Public Inspection No. 7-285265.

Further, listed as nonion-modified polyvinyl alcohol are, for example, polyvinyl alcohol derivatives described in Japanese Patent Publication Open to Public Inspection No. 7-9758, in which a polyalkylene oxide group is added to one part of polyvinyl alcohol, and block copolymers of vinyl compounds having a hydrophobic group and vinyl alcohol, described in Japanese Patent Publication Open to Public Inspection No. 8-25795.

At least two types of polyvinyl alcohol, which have a different degree of polymerization or a different type of modification, may be employed in combination. Particularly, when polyvinyl alcohol, having a degree of polymerization of at least 2,000, is employed, it is preferable that after adding polyvinyl alcohol, having a degree of polymerization of no more than 1,000, to fine inorganic particle dispersion in an amount of 0.05 to 10 percent by weight with respect to the fine inorganic particles, and more preferably in an amount of 0.1 to 5 percent by weight, polyvinyl alcohol, having a degree of polymerization of at least 2,000, is added so that a marked increase in viscosity of the resulting mixture does not occur.

The ratio of fine particles to the hydrophilic binders of the porous layer is preferably from 2 to 20 times in terms of weight ratio. When said weight ratio is less than two times, the void ratio of the porous layer decreases. As a result, it becomes difficult to obtain the desired void volume. In addition, excessive hydrophilic binders swell during ink-jet recording and block voids, becoming a factor in the decrease of the ink absorption rate. On the other hand, when said ratio exceeds 10 times, undesirable cracking tends to occur during coating a relatively thick porous layer. The ratio of fine particles to said hydrophilic binders is more preferably from 2.5 to 12 times, and is most preferably from 3 to 10 times.

Employed as substrates used in the ink-jet recording sheet of the present invention may be water absorptive substrates (for example, paper) as well as non-water absorptive substrates, but from the viewpoint of making it possible to obtain more high quality prints, non-water absorptive substrates are more preferred.

When water absorptive substrates are employed, it becomes difficult to obtain high quality prints. In addition, the components of each additive, which has been overcoated, diffuses into said paper after coating whereby the original effects of said additive are largely lost.

Listed as preferably employed non-water absorptive substrates are, for example, polyester based films, diacetate based films, triacetate based films, polyolefin based films, acryl based films, polycarbonate based films, polyvinyl chloride based films, and polyimide based films, and transparent or opaque films comprised of materials such as cellophane and celluloid, as well as resin coated papers or so-called RC papers which are prepared by covering both sides of a base paper with a polyolefin resinous covering layer.

When said water-soluble coating composition is applied onto the aforesaid substrate, for the purpose of increasing the adhesion strength between the surface and the coating, said substrate is preferably subjected to a corona discharge treatment or a subbing treatment. Further, the ink-jet recording sheets of the present invention are not always required to be white. Therefore, colored substrates may be employed.

The substrates preferably employed in the present invention include transparent polyester films, opaque polyester films, opaque polyolefin resinous films, and paper substrates which are prepared by laminating both sides of paper with polyolefin resins of these, the particularly preferred substrates are paper substrates laminated with polyolefin resins, which are the invention according with item (5). When a small amount of an overcoating composition is applied, it is possible to make drying substantially unnecessary.

The polyolefin laminated paper substrates, laminated with polyethylene, which is a representative of the most preferred polyolefin, will now be described.

Base paper, employed in said paper substrates of the present invention, is made employing wood pulp as the main raw material and in addition, if desired, synthetic pulp such as polypropylene and synthetic fiber such as nylon and polyester. Employed as said wood pulp may be any of LBKP, LBSP, NBKP, NBSP, LDP, NDP, LUKP, and NUKP. However, it is preferable that LBKP, NBSP, LBSP, NDP, and LDP comprising a short fiber component in a relatively large amount are preferably employed. Incidentally, the ratio of LBSP or LDP is preferably from 10 to 70 percent by weight.

Preferably employed as said pulp is chemical pulp (sulfate pulp and sulfite pulp) comprising minimal impurities. Further, also useful is pulp which has been subjected to a bleaching treatment to increase its whiteness.

Suitably incorporated into said paper base may be sizing agents such as higher fatty acids and alkylketene dimer; white pigments such as calcium carbonate, talc, and titanium oxide; paper strength enhancing agents such as starch, polyacrylamide, and polyvinyl alcohol; optical brightening agent; moisture maintaining agents such as polyethylene glycols; dispersing agents; and softeners such as quaternary ammonium.

The degree of water freeness of pulp employed for paper making is preferably between 200 and 500 ml according to CSF Specification. Further, the sum of weight percent of 24-mesh residue and weight percent of 42-mesh calculated portion regarding the fiber length after beating, specified in JIS P 8207, is preferably between 30 and 70 percent. Further, the weight percent of 4-mesh residue is preferably no more than 20 percent by weight.

The weight of said paper base is preferably from 30 to 250 g, and is most preferably from 50 to 200 g. The thickness of paper is preferably from 40 to 250 μm. During the paper making period or after said paper making period, said base paper may be subjected to a calendering treatment to result in optimal smoothness. The density of said paper is generally from 0.7 to 1.2 g/m$^2$ (in accordance with the method specified in JIS P 8118). Further, the stiffness of said base paper is preferably from 20 to 200 g under the conditions specified in JIS P 8143. Surface sizing agents may be applied onto the paper surface. Employed as said surface sizing agents may be the same as those described above, capable of being incorporated into said base paper. The pH of said base paper, when determined employing the hot water extraction method specified in JIS P 8113, is preferably from 5 to 9.

Polyethylene, which covers both surfaces of said base paper, is mainly comprised of low density polyethylene (LDPE) or high density polyethylene (HDPE), but it is also acceptable to partially employ LLDPE and polypropylene.

Further, as widely applied to photographic print papers, rutile or anatase type titanium dioxide is preferably incorporated into the polyolefin layer on the coating layer side so as to improve opacity as well as whiteness. The content ratio of said titanium oxide is commonly from 1 to 20 percent by weight with respect to polyolefin, and is preferably from 2 to 15 percent by weight.

It is possible to employ as glossy paper said polyethylene coated paper. Further, in the present invention, it is possible to employ polyethylene coated paper with a matt or silk surface, as obtained in the conventional photographic paper, by carrying out an embossing treatment during extrusion coating of polyethylene onto said base paper.

The used amount of polyethylene on both surfaces of said paper is selected so as to optimize the layer thickness of a water based coating composition as well as curling at low and high humidity after providing a back layer. The thickness of the polyethylene layer on the side onto which the water based coating composition in accordance with the present invention is applied, is preferably in the range of 20 to 40 μm, while the thickness of the polyethylene layer on the opposite side is preferably in the range of 10 to 30 μm.

Further, it is preferable that said polyethylene coated substrate exhibits the characteristics described below.

(1) Tensile strength is preferably from 20 to 300 N in the longitudinal direction and from 10 to 200 N in the lateral direction, in terms of the strength specified in JIS P 8113.

(2) Tear strength is preferably from 0.1 to 2 N in the longitudinal direction and from 0.2 to 2 N in the lateral direction in terms of the tear strength specified in JIS P 8116.

(3) Compression elasticity is no less than 1,030 N/cm$^2$.

(4) Bekk surface smoothness is preferably at least 500 seconds under conditions specified in JIS P 8119, however so-called embossed papers may exhibit less than that.

(5) Bekk rear surface smoothness is preferably from 100 to 800 seconds under conditions specified in JIS P 8119.

(6) Opacity is preferably no more than 20 percent and is most preferably no more than 15 percent in terms of the transmittance of light in the visible region, which is determined under conditions of parallel light incidence/diffused light transmission.

(7) Whiteness is preferably at least 90 percent in terms of Hunter's brightness specified in JIS P 8123. Further, when measurement is carried out utilizing JIS Z 8722 (non-fluorescence) and JIS Z 8717 (incorporation of fluorescent agents) and the color is represented utilizing the color specification specified in JIS Z 8730, it is preferable that L*=90 to 98, a*=−5 to +5, and b*=−10 to +5.

For the purpose of enhancing adhesion to the ink receptive layer, a subbing layer is preferably provided on the ink receptive layer side of said substrate. Binders for said subbing layer are preferably hydrophilic polymers such as gelatin, polyvinyl alcohols, and latex polymers having a Tg of −30 to 60° C. Said binders are employed in an amount of 0.001 to 2 g per m$^2$ of the recording sheet. For the purpose of minimizing static charge, a small amount of antistatic agent such as cationic polymers, conventionally known in the art, may be incorporated.

For the purpose of improving slipping properties as well as electrification characteristics, a back layer may be provided on the surface opposite the ink receptive layer of said substrate. Binders for said back layer are preferably hydrophilic polymers such as gelatin, polyvinyl alcohols, and latex polymers having a Tg of −30 to 60° C. Further, also incorporated may be antistatic agents such as cationic polymers, various types of surface active agents, and in addition, about 0.5 to about 20 μm matting agents. The thickness of said backing layer is from about 0.1 to about 1 μm. However, when said backing layer is provided to minimize curling, its thickness is to be from about 1 to about 20 μm. Further, said backing layer may be comprised of at least two layers.

When said subbing layer, as well as said back layer, is coated, surface treatments such as a corona treatment or a plasma treatment applied onto the substrate surface are preferably employed in combination.

Various types of additives can be incorporated into the water-soluble coating composition which forms said porous layer. Listed as said additives are, for example, cationic mordants, cross-linking agents, surface active agents (being cationic, nonionic, anionic, or amphoteric), background color modifiers, optical brighteners, antiseptics, viscosity modifiers, low-boiling-point organic solvents, high-boiling-point organic solvents, latex emulsions, anti-discoloring agents, UV absorbers, multivalent metallic compounds, (being water-soluble or water-insoluble), matting agents, and silicone oil of these, cationic mordants are preferred to enhance waterfastness as well as moisture resistance.

Employed as said cationic mordants are polymer mordants having a primary, secondary, or tertiary amino group or a quaternary ammonium salt group. Of these, polymer mordants having a quaternary ammonium salt group are preferred, which result in minimal discoloration as well as minimal degradation of lightfastness during storage, and exhibit sufficiently high mordant capability toward dyes.

Said preferred mordants are prepared as either homopolymers of monomers having said quaternary ammonium salt group or copolymers, and condensation polymers of said monomers with other monomers.

Further, it is particularly preferred to incorporate cross-linking agents of hydrophilic binders. By employing said cross-linking agents, the waterfastness of the porous layer is enhanced, and in addition, the ink absorbing rate is also enhanced during ink-jet recording due to the fact that the swelling of said hydrophilic binders is retarded.

Employed as said cross-linking agents may be those known in the prior art, which include inorganic cross-linking agents (for example, chromium compounds, aluminum compounds, zirconium compounds, and boric acids), and organic cross-linking agents (for example, epoxy based cross-linking agents, isocyanate based cross-linking agents, aldehyde based cross-linking agents, N-methylol based cross-linking agents, acryloyl based cross-linking agents, vinylsulfone based cross-linking agents, active halogen based cross-linking agents, carbodiimide based cross-linking agents, and ethyleneimine based cross-linking agents).

The content ratio of said cross-linking agents is commonly from about 1 to 50 percent by weight with respect to the hydrophilic binder, and is preferably from 2 to 40 percent by weight.

When said hydrophilic binders are comprised of polyvinyl alcohols and fine articles are comprised of silica, particularly preferred as cross-linking agents are inorganic cross-linking agents such as boric acids and zirconium compounds, as well as epoxy based cross-linking agents.

The specifically preferred embodiment is as follows. When polyvinyl alcohol and fine silica particles are employed, by employing boric acid or salts thereof, a decrease in temperature of a water-soluble coating composition results in a marked increase in its viscosity. As a result, even though a strong airflow is applied onto the resulting coated surface, the unevenness of the coating is markedly minimized so as to more easily carry out high speed coating. Boric acids or salts thereof refer to oxygen acids having a boron atom as the center atom and salts thereof, and specifically include orhtoboric acid, metaboric acid, hypoboric acid, tetraboric acid, pentaboric acid and salts thereof (for example, sodium salts, potassium salts, and ammonium salts).

The used amount of boric acids or salts thereof varies to a large extent depending upon the concentration of fine inorganic particles as well as polyvinyl alcohol and the pH, but is commonly from 5 to 60 percent by weight with respect to said polyvinyl alcohol, and is preferably from 10 to 40 percent by weight.

Said coating composition comprising boric acids will now be detailed.

When the viscosity, at 15° C., of the coating composition comprising said boric acids and polyvinyl alcohol, as a hydrophilic binder, is at least 20 times greater than its viscosity at 40° C., it is possible to dry the coating layer utilizing a strong airflow after coating followed by chilling and setting said coating. As a result, it is preferred from the viewpoint of high speed coating and drying properties. The increase in viscosity at 15° C. is preferably at least 50 times that at 40° C., and is more preferably at least 100 times. The temperature during coating is generally maintained at 30 to 50° C. However, the viscosity of said coating composition is preferably from about 10 to about 500 mpa·s at 0° C., because said coating composition is more easily handled in that state. The viscosity, as described herein, refers to the value determined employing a B type viscosimeter.

In order to achieve the desired physical properties of the coating composition, as described above, it is an effective means to result in hydrogen bond type interaction between said hydrophilic binders and said fine inorganic particles. Said hydrogen bond is relatively weak. As a result, when the temperature is raised, said bond tends to be easily broken due to the molecular movement, whereby said coating composition tends to exhibit low viscosity at relatively high temperature and high viscosity at relatively low temperature. As a result, after applying said coating composition onto a substrate, its viscosity is preferably increased to a great extent by chilling said coating composition, as described above.

The coating temperature of said coating composition is commonly from 30 to 60° C., and the chilling temperature after coating is preferably adjusted so that the temperature of the coated layer is no higher than 20° C., and is preferably no higher than 15° C.

Said chilling can be carried out, for example, by passing a coating through a chilling period of no higher than 15° C. for a definite period (preferably at least 5 seconds) after coating. From the viewpoint of forming a uniform coating which results in neither unevenness nor streaking, it is preferable that an excessively strong airflow is not applied during said chilling period.

After once chilling the coating, unevenness of the coated composition tends not to occur due to an increase in the viscosity of the coating composition itself. As a result, even though a strong airflow is then applied, it is possible to minimize unevenness of the coating composition. Further, it is possible to apply said strong airflow at least 20° C., however, it is preferable that the temperature of said airflow is gradually raised.

Drying, after applying said water-soluble coating composition onto a substrate, is carried out by blowing an airflow on the coating or by passing the coating through a period maintained at a relatively high temperature, or by employing both in combination.

When drying is carried out by passing the coating through said high temperature period, specifically, it is passed through a drying period at 50 to 150° C. In this case, it is preferable that an appropriate drying temperature is selected while taking into account the heat resistance of the substrate and possible adverse effects to the coating. The relative humidity of said drying airflow is commonly from 10 to 50 percent, and is preferably from 15 to 40 percent. The drying time, though varied depending upon the wet layer thickness, is preferably no more than about 10 minutes, and is most preferably no more than 5 minutes.

The coating speed, though varied depending upon the wet layer thickness and the drying capacity of the equipment, is generally from 10 to 1,000 m per minute, and is preferably from 20 to 500 m per minute.

Incidentally, it is preferable that additives, which exhibit such characteristics, that when added to said coating composition, they result in neither gelling and coagulation through immediate reaction nor decomposition, but instead result in reaction or decomposition during extended standing of the coating composition, are mixed with said coating composition employing an in-line method just prior to coating. Just prior to coating, as described herein, refers to a period of 1 second to 10 minutes until coating.

It is possible to coat said coating composition employing a method which is suitably selected from the several methods known in the art. Preferably employed coating methods include, for example, a gravure coating method, a roll coating method, a rod bar coating method, an air knife coating method, a spray coating method, an extrusion coating method, a curtain coating method, or an extrusion coating method employing a hopper, described in U.S. Pat. No. 2,681,294.

The porous layer in accordance with the recording sheet of the present invention may be comprised of a single layer or a multilayer. In the case of said multilayer, from the viewpoint of reducing production cost, it is preferable that all the layers be simultaneously coated.

The additive containing solution employed for overcoating will now be described.

The present invention is characterized in that a porous layer forming water-soluble coating composition comprising hydrophilic binders as well as fine particles is applied onto a substrate, and after the volume of water incorporated in the coating becomes no more than of the void volume of said porous layer, said additive-containing solution is overcoated.

Employed as additives which are incorporated in said solution for overcoating are compounds which may be incorporated in said coating composition, but compounds which tend to increase cracking during drying, are compounds which result in coagulation, and an excessive increase or decrease in viscosity of said coating composition when added to said coating composition, and further, compounds which exhibit difficulty to result in useful effects due to reaction with water or other additives in said coating composition when added to said coating composition. For example, listed are organic or inorganic acids or various types of alkaline additives whose addition varies the pH, water-soluble salts of water-soluble multivalent metal ions, various anionic, cationic, amphoteric or nonionic surface active agents, discoloring agents, cationic fixing agents, and cross-linking agents of hydrophilic binders.

Listed as acids, which are employed to lower the pH of the porous layer surface, may be, for example, inorganic acids such as sulfuric acid, hydrochloric acid, nitric acid, and phosphoric acid, as well as organic acids such as citric acid, formic acid, acetic acid, phthalic acid, succinic acid, oxalic acid, and polyacrylic acid. The pH of a solution comprising these is preferably from 0 to 6. The invention according to item (13) is characterized in that the pH is from 1 to 5. Further, the pH of the final layer surface after pH adjustment is preferably from 3 to 7, and is most preferably from 3.5 to 6.

The coating method to apply (or overcoat) a solution containing an additive on the porous layer is not specially limited.

Listed as alkalis, which are employed to increase the pH of the porous layer surface, may be, for example, sodium hydroxide, potassium hydroxide, sodium carbonate, potassium carbonate, borax, sodium phosphate, calcium hydroxide, and organic amines. The pH of a solution comprising these alkalis is from 8 to 14. The invention according to item (14) is characterized in that the pH is from 8 to 13, and is most preferably from 9 to 12.

Said pH moderators are most preferably employed when the pH of the porous layer forming coating composition is different from the preferred pH of the layer surface of the recording sheet.

The pH of the porous layer surface of recording sheets varies depending upon the types of inks. The general trend is that in the more acidic region, the waterfastness of dyes is enhanced and bleeding is minimized, while in the higher pH region, the lightfastness is enhanced. As a result, an optimal pH is selected depending upon combinations of employed inks. The pH of the porous layer surface is preferably from 3 to 7, and is most preferably from 3.5 to 6.5. The pH of the layer surface, as described herein, refers to the value determined based on the Paper Surface pH Measurement Method, specified in J. TAPPI 49. Specifically, it refers to the value determined as follows: 50 μl of pure water (having a pH of 6.2 to 7.3) is dripped on the surface of a recording sheet, and the pH of the resulting water droplet is determined employing a commercially available flat electrode.

The present invention is characterized in that the additive solution, which is overcoated utilizing an on-line means, comprises a cross-linking agent of a hydrophilic binder.

Listed as cross-linking agents usable in the present invention may be those which have been described.

In the present invention, one of preferred embodiments is as follows. The cross-linking agents of hydrophilic binders are previously incorporated in a porous layer forming water-soluble coating composition. Further, cross-linking agents are incorporated in an additive containing solution employed for overcoating. In such a case, ink absorbability is effectively and markedly increased due to an effective increase in cross-linking of said hydrophilic binders. It is assumed that by adding said cross-linking agents to the porous layer forming coating composition, the apparent molecular weight of said hydrophilic binders increases and a layer, which is not easily swelled, is formed, since these, when formed as layers, will supply said cross-linking agents.

Cross-linking agents, which are employed for their overcoat, may be the same as those incorporated in the water-soluble coating composition or different from those. The content ratio of cross-linking agents for the overcoat to the hydrophilic binders is from 1 to 100 percent by weight, and is preferably from 5 to 50 percent by weight. Particularly preferred cross-linking agents include the aforesaid boric acids, zirconium salts, aluminum salts, or epoxy based cross-linking agents.

The present invention is characterized in that the additive solution for the overcoat utilizing an on-line means comprises image stabilizer (hereinafter occasionally referred to as anti-discoloring agents).

In the present invention, employed may be conventional anti-discoloring agents known in the art. Said anti-discoloring agents minimize color fading due to light irradiation, as well as color fading due to oxidizing gases such as operid, active oxygen, $NO_x$, and $SO_x$. Listed as such anti-discoloring agents may be, for example, antioxidants described in Japanese Patent Publication Open to Public Inspection Nos. 57-74192, 57-87989, and 60-72785; UV absorbers described in Japanese Patent Publication Open to Public Inspection No. 57-74193; hydrazides described in Japanese Patent Publication Open to Public Inspection No. 61-154989; hindered amine based antioxidants described in Japanese Patent Publication Open to Public Inspection No. 61-146591; nitrogen-containing heterocyclic mercapto based compounds described in Japanese Patent Publication Open to Public Inspection No. 61-177279; thioether based antioxidants described in Japanese Patent Publication Open to Public Inspection Nos. 1-115677 and 1-36479; specified structure hindered phenol based antioxidants described in Japanese Patent Publication Open to Public Inspection No. 1-36480; ascorbic acids described in Japanese Patent Publication Open to Public Inspection Nos. 7-195824 and 8-150773; zinc sulfate described in Japanese Patent Publication Open to Public Inspection No. 7-149037; thiocyanate salts described in Japanese Patent Publication Open to Public Inspection No. 7-314882, and thiourea derivatives described in Japanese Patent Publication Open to Public Inspection No. 7-314883; saccharides described in Japanese Patent Publication Open to Public Inspection Nos. 7-276790 and 8-108617; phosphoric acid based antioxidants descried in Japanese Patent Publication Open to Public Inspection No. 8-118791; nitrite salts, sulfite salts, and thiosulfate salts described in Japanese Patent Publication Open to Public Inspection No. 8-300807; and hydroxylamine derivatives described in Japanese Patent Publication Open to Public Inspection No. 9-267544. In addition, the polymerization condensation product of dicyandiamide and polyalkylene polyamine, described in Japanese Patent Publication Open to Public Inspection No. 2000-263928, is one of the effective anti-discoloring agents.

Said anti-discoloring agents may be added to the porous layer forming coating composition. However, in the present invention, in order to minimize coagulation of said coating composition, as well as to prevent an increase in cracking, it is preferable to employ the overcoating method which is capable of applying those in a greater amount.

The added amount of anti-discoloring agents is commonly in the range of 0.01 to 5 g per $m^2$ of the recording sheet, and is preferably in the range of 0.1 to 2 g. As the added amount increases, the resulting anti-discoloring effects increase. However, the added amount is naturally limited due to a decrease in the resulting void volume.

Cationic polymers may be incorporated in the additive containing solution.

Generally, said cationic polymers function as a dye fixing agent. In order to enhance the resulting waterfastness as well as to minimize any resulting bleeding, it is preferable that they are previously added to the porosity receptive layer forming coating composition. However, when problems occur while adding them to the coating composition, it is possible to supply them utilizing the overcoating method. For example, when said coating composition results in an increase in viscosity during storage, or coloring properties are improved by specifying the distribution of cationic polymers in the porous layer, it is preferable that they are supplied utilizing the overcoat method. When said cationic polymers are supplied utilizing the overcoating method, the resulting amount is commonly in the range of 0.1 to 5 g per $m^2$ of the recording sheet.

The present invention is characterized in that the additive solution, which is overcoated utilizing an on-line means, comprises water-soluble multivalent metal compounds.

Generally, said water-soluble multivalent compounds, when present in the coating composition comprising fine inorganic particles, frequently result in coagulation which tends to results in minute coating defects as well as in a decrease in glossiness. As a result, it is preferable that they are supplied utilizing the overcoating method.

Employed as such multivalent metallic compounds are sulfates, chlorides, nitrates, and acetates of $Mg^{2+}$, $Ca^{2+}$, $Zn^{2+}$, $Zr^{2+}$, $Ni^{2+}$, and $Al^{3+}$. Incidentally, examples of preferred water-soluble multivalent metallic compounds include inorganic polymer compounds such as basic polyaluminum hydroxide and zirconyl acetate. Generally, many of these water-soluble compounds exhibit functions to enhance lightfastness as well as waterfastness, or minimize bleeding. The content of these water-soluble multivalent metal ions is commonly in the range of 0.05 to 20 millimoles per $m^2$ of the recording sheet, and is preferably in the range of 0.1 to 10 millimoles.

The present invention is characterized in that the additive solution, which is overcoated utilizing an on-line means, comprises surface active agents.

Said surface active agents enable controlling the dot diameter during ink-jet recording. Listed as such surface active agents may be anionic, cationic, amphoteric, or non-ion based surface active agents. Further, at least two surface active agents may be employed in combination. The added amount of said surface active agents is commonly from 0.01 to 50 mg per $m^2$ of the recording sheet. When said added amount exceeds 50 mg, mottled unevenness tends to occur during ink-jet recording.

Said additive containing solution can comprise various additives other than those described above. Listed as such other additives may be dyes to adjust background color, mildewcides, water-soluble polymers, and plasticizers (glycerin and diethylene glycol).

The additives described above may be employed individually or in combination of two or more types. Specifically, it is possible to employ an aqueous solution comprising at least two anti-discoloring agents, a solution comprising anti-discoloring agent(s) as well as cross-linking agent(s), a solution comprising anti-discoloring agent(s) as well as surface active agent(s). Further, it is possible to employ cross-linking agent(s), water-soluble multivalent metallic compound(s) and anti-discoloring agent(s) in combination.

The present invention is characterized in that employed as solvents of said additive containing solution, is water or a solution consisting of water and a water-compatible organic solvent. Water is preferably employed. Further, a solvent mixture consisting of water and a water-compatible low-boiling-point organic solvent (for example, methanol, ethanol, i-propanol, n-propanol, acetone, and methyl ethyl ketone) is also preferably employed. When water, as well as a water-compatible organic solvent, is employed in combination, the content ratio of water is preferably 50 percent by weight.

The water-compatible low-boiling-point organic solvents, as described herein, refer to the organic solvents which exhibit a solubility of at least 10 percent by weight in water at room temperature and have a boiling point of no more than approximately 120° C.

The present invention is characterized in that the viscosity of said additive containing solution is at least 100 mPa·s. When said viscosity exceeds 100 mPa·s, its penetrating property into the porous layer decreases tending to result in unevenness on the surface as well as to decrease ink absorbability. Said viscosity is preferably from 0.5 to 20 mPa·s.

Further, from the viewpoint of obtaining uniform coatability, the surface tension of the additive containing solution is preferably from 200 to 600 μN/cm.

Methods for drying and coating the additive containing solution will now be described.

In the present invention, the coating of the each additive containing solution (coating utilizing a overcoating method) is characterized in that initially, a porous layer forming water-soluble coating composition is applied onto a substrate, and subsequently, an overcoat application is carried out after the volume of water incorporated in the coating becomes less than the void volume after drying.

The void volume of the porous layer, as described in the present invention, refers to the liquid transition amount during 2 seconds of contact time when a finished recording sheet is measured employing the Method for Determining the Liquid Absorbability of Paper and Board (Bristow's Method) specified in J. TAPPI and Test Method No. 51.

Generally, "after the volume of water incorporated in the coating becomes less than the void volume after drying", as described in the present invention, corresponds primarily to after the falling drying rate period in the drying region. In said falling drying rate period, a phenomenon occurs in which the rate of water evaporation from the surface of the coating exceeds the rate of water movement in the coating in the layer. Generally, the formation of voids starts after the coating is introduced into said falling drying rate period and water is further evaporated.

When coating is carried out during the period in which drying is insufficient and the volume of the incorporated water exceeds the void volume, the resulting glossiness, as well as various ink-jet recording characteristics, tends to not be uniform due to the formation of coagulation on the surface and the flow of the coating composition during the drying process.

Further, even though the volume of water incorporated in the coating is no more than the void volume, when repeated coating is carried out after once drying the coating and the resulting coating is wound into a roll, the state of hydrophilic binders varies due to the aging of the coating, and manufacturing fluctuation tends to occur. Therefore, it is essential that coating be carried out before being wound into a roll. In the present invention, to apply a solution containing an additive on-line means to add the solution to the layer before being dried and being wound into a roll.

The preferred time when the additive containing solution is coated is the time when the water-soluble coating composition is coated and drying is carried out, until the total volume of water incorporated in the coating and said solution becomes no more than the void volume. The most preferred time is the time when drying is carried out so that the water content in the coating is substantially in equilibrium with ambient air.

As described above, the coated volume of the additive containing solution varies at the drying time of the coating and is selected so that the total volume of water incorporated in the coating and the solution becomes no more than the void volume during drying. The void volume of the porous layer after drying is the same meaning as the void volume at the last period of drying. The void volume of the porous layer does not change after the last period of drying.

When the additive containing solution is coated onto the coating which has been subjected to the particularly preferred state in which the water content of said coating is in equilibrium with ambient air, the invention according to item (2) is characterized in that the total volume of the water incorporated in said coating and the additive containing solution is no less than 1.5 times the void volume of the porous layer after drying, and is preferably from 0.05 to 1.5 times the void volume. When said total volume is less than 0.05 time of said void volume, said solution tends to not be uniformly coated. On the other hand, when said total volume exceeds 1.5 times, the coated solution flows too freely so that the unevenness of the coating tends to occur. The supply volume of said solution is preferably from 0.1 to 1.2 times the void volume. Further, the present invention is characterized in that when an additive containing solution is coated, the total volume of water incorporated in the coating and the water of said additive containing solution is no more than 7 percent by weight of the paper sheet.

Said additive containing solution may be applied onto the porous layer once or may be applied two or more times. In this case, it is necessary that during each coating period, coating be carried out so that the total volume of water incorporated in the resulting coating and water of said solution is no more than the void volume of the porous layer.

The invention according to item (4) is characterized in that after coating an additive containing solution, the resultant coating is wound while not being substantially dried. In the present invention, "not being substantially dried" means that after applying said additive containing solution onto the porous layer, the resultant coating is dried by being passed through a high temperature period or having air blown on it. However, when the total volume of water incorporated in said coating and the supplied solution is no more than approximately 0.3 time the void volume, a drying process is not always necessary.

Even though a non-water absorptive substrate is employed, in the case of substrates on which both sides are laminated with polyolefin resin, said polyolefin resin exhibits characteristics in which water is allowed to penetrate through it during storage. As a result, even when a great amount of said solution is coated, drying does not always become necessary depending upon the water content after coating.

Namely, when after coating, the resultant coating is not substantially dried, wound into a roll, and stored for several days, water in the coated solution is absorbed into the paper base through the polyolefin layer. In such case, the porous layer is stored under a highly moisturized state over a relatively extended period such as half a day to several days. As a result, the relaxation process of the resulting layer tends to proceed so that a more stable layer state is achieved. Particularly, when additives are cross-linking agents, a higher ink absorption rate tends to be achieved.

When such purposes are to be achieved, in the case of the paper substrate which is prepared by laminating both sides with polyolefin resin, the invention according to claim 8 is characterized in that the water content of said paper is no more than 8 percent by weight. Said water content is easily achieved by laminating the paper after placing it in a relatively low moisture condition. The use of the substrate, which is prepared by laminating both sides of paper having a relatively low water content as described above with polyolefin resin, exhibits the advantage in which it is possible to easily prepare a target recording sheet without employing complicated drying processes after coating said solution.

The water content ratio of said paper is preferably from 2 to 7 percent by weight, and is most preferably from 2 to 5 percent by weight. Further, the present invention is characterized in that when an additive containing solution is coated, the total volume of the water incorporated in the resultant coating and water of said additive containing solution is no more than 7 percent by weight of the paper weight.

The solution supplying method, which requires no drying process, as described above, is usable in the case in which the solvent of said solution is substantially comprised of water (at least 90 percent of the solvent is preferably comprised of water) and the water supply amount is no more than 10 ml per $m^2$ of the recording sheet. Further, the weight of said paper is preferably from 100 to 250 $g/m^2$.

When a paper substrate is used, which is prepared by laminating both sides of paper with polyolefin, and an additive containing solution is overcoated, followed by no substantial drying, the content ratio of solvents in said aqueous additive containing solution is preferably at least 90 percent, and the content ratio of water is most preferably at least 99 percent. In this case, the total volume of water incorporated in the resulting coating and solvents in said aqueous additive containing solution is preferably no more than 7 percent of the paper.

Further, the water amount, which passes through a polyethylene layer, depends on the thickness of said polyethylene layer. Accordingly, the thickness of said polyethylene layer is preferably from 10 to 50 μm. When said thickness is less than 10 μm, it is difficult to maintain the sufficient high humid period in the layer due to excessively rapid diffusion of water. On the other hand, when said thickness exceeds 50 μm, it takes time to transport and diffuse water, whereby the period from product production to shipment is extended.

It is possible to coat said solution employing a suitable method selected from those known in the art. Employed as specific methods may be those described in coating of the aforesaid porous layer.

Solvents are preferably coated from room temperature (about 20° C.) to 60° C.

The recording sheet of the present invention, which has been coated with solvents, and if desired, has been dried, is commonly wound into a roll. Further, the resultant recording sheet is stored at 30 to 60° C. for a definite period, for example one day or one month, in the form of said roll without any modification or after cutting said roll into sheets or smaller rolls of various sizes, whereby it is possible to obtain the target quality.

Preferred physical properties of the recording sheet of the present invention will now be described hereunder.

(1) Glossiness at 60 degrees is from 20 to 60 percent for a glossy surface, from 12 to 40 percent for a fine-grained surface, and from 5 to 12 percent for a matt surface.

Incidentally, when printing is carried out employing a water based dye ink, the glossiness after printing is preferably from −5 percent to +20 percent of the non-printed area.

(2) Smoothness by the Bekk method (specified in JIS P 8119) of the surface of the ink receptive layer is preferably at least 800 seconds for a glossy surface, from 200 to 1,000 seconds for a fine-grained surface, and from 50 to 300 seconds for a matt surface.

(3) Roughness (Surface Roughness Ra specified in JIS B 0601) is preferably from 0.1 to 0.8 μm for a glossy surface and from 1.0 to 3.0 μm for a fine-grained surface. Further, opposite surface Ra is preferably from 0.5 to 5 μm.

(4) Opacity (specified in JIS P 8138) is preferably at least 90 percent; and is most preferably at least 92 percent.

(5) Taber stiffness (specified in JIS P 8125) is preferably from 0.3 to 3 mN·m/MD and from 0.2 to 2.5 mN·m/CD.

(6) Brightness (JIS P 8123/a case comprising no optical brightening agents), and JIS P 8143/a case comprising optical brightening agents) is preferably at least 90 percent.

(7) Whiteness (measured in accordance with JIS Z 8722 (non-fluorescence) or JIS Z 8717(comprising optical brightening agents), and expressed in accordance with JIS Z 8730) preferably has L* of 90 to 98, a* of −3 to +3, and b* of −10 to +2. However, in the case of printing sheets, Japan, The United States, and Europe each recommend a preferred background (for example, Japan Color). Therefore, when the recording sheets are employed for said purpose, it is preferable that said recording sheets exhibit the whiteness recommended by each respective country.

The recording sheet of the present invention is employed for ink-jet recording, employing an ink which is mainly comprised of acidic dyes. However, said recording sheet may also be employed for ink-jet recording, employing a water based or oil based pigment ink.

EXAMPLES

The present invention will now be described with reference to examples. However, the present invention is not limited to these examples. Incidentally, in these examples "percent" is "percent by weight", unless otherwise specified.

Example 1

<<Preparation of Recording Sheets 1 through 4: Comparative Examples>>

(Preparation of Silica Dispersions D1 and D2)

While stirring at 3,000 rpm, added at room temperature to 110 L of aqueous solution C1 (having a pH of 2.3, and comprising 2 g of antifoaming agent SN381, manufactured by Sun Nobco Co.) comprising 12 percent of Cationic Polymer P-1, 10 percent of n-propanol, and 2 percent of ethanol was 40 L of preliminarily and uniformly dispersed silica dispersion B1 (having a pH of 2.3 and comprising 1 percent of ethanol) comprising 25 percent of gas phase method silica (A200, manufactured by Nippon Aerosil Co.) having an average primary particle diameter of approximately 0.012 μm, and 0.3 percent of water-soluble optical brightening agent, Uvitex New Liquid (manufactured by Ciba Specialty Chemicals Co.).

Subsequently, 54 L of aqueous solution A1 (having each concentration of 3 percent) comprising boric acid and borax at a ratio of 1:1 by weight, was gradually added while stirring.

Thereafter, the resultant mixture was dispersed at a pressure of 3,000 N/cm$^2$, employing a high pressure homogenizer, manufactured by Sanwa Kogyo Co., Ltd. The total volume was then adjusted to 630 L, whereby almost transparent silica dispersion D1 was prepared.

On the other hand, while stirring at 3,000 rpm, added at room temperature to 120 L of aqueous solution C2 (having a pH of 2.5) comprising 12 percent of Cationic Polymer P-2, 10 percent of n-propanol, and 2 percent of ethanol was 400 L of said silica dispersion B1, and subsequently, 52 L of said aqueous solution A1 was gradually added while stirring.

Thereafter, the resultant mixture was dispersed at a pressure of 3,000 N/cm$^2$, employing a high pressure homogenizer, manufactured by Sanwa Kogyo Co., Ltd. The total volume was then adjusted to 630 L, whereby almost transparent silica dispersion D2 was prepared.

Each of said silica dispersions D1 and D2 was filtered employing a TCP-30 Type Filter, having a filtration accuracy of 30 μm, manufactured by Advantech Toyo Co.

(Preparation of Oil Dispersion)

While heating, added to 45 kg of ethyl acetate were 20 kg of diisodecyl phthalate and 20 kg of Antioxidant AO-1, and subsequently dissolved. At 55° C., mixed with the resultant solution was 210 L of an aqueous gelatin solution comprising 8 kg of acid process gelatin, 2.9 kg of Cationic Polymer P-1, and 10.5 kg of saponin. The resultant mixture was emulsify-dispersed employing a high pressure homogenizer. Thereafter, the volume of the resultant dispersion was adjusted to 300 L with pure water, whereby an oil dispersion was prepared.

Cationic Polymer P-1

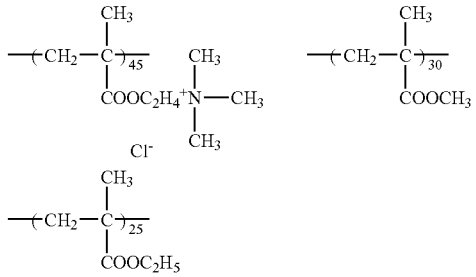

Cationic Polymer P-2

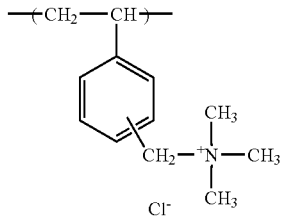

Antioxidant AO-1

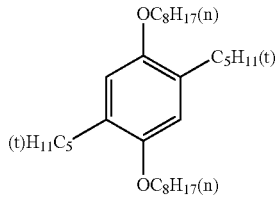

(Preparation of Coating Compositions)

Coating compositions were prepared by successively adding each of the additives described below to each of the dispersions prepared as above. Incidentally, each additive amount is expressed per L of the coating composition.

| (First layer coating composition: lowermost layer) | |
|---|---|
| Silica Dispersion D1 | 580 ml |
| 10 percent aqueous solution of polyvinyl alcohol (PVA 203, manufactured by Kuraray Co., Ltd.) | 5 ml |
| 6.5 percent aqueous solution of polyvinyl alcohol (having an average degree of polymerization of 3,800 and a saponification ratio of 88 percent) | 290 ml |
| Oil dispersion | 30 ml |
| Latex dispersion (AE803, manufactured by Showa Kobunshi Co.) | 42 ml |
| Ethanol | 8.5 ml |
| Pure water to make | 1000 ml |
| (Second Layer Coating Composition) | |
| Silica Dispersion D1 | 600 ml |
| 10 percent aqueous solution of polyvinyl alcohol (PVA 203, manufactured by Kuraray Co., Ltd.) | 5 ml |
| 6.5 percent aqueous solution of polyvinyl alcohol (having an average degree of polymerization of 3,800 and a saponification ratio of 88 percent) | 270 ml |
| Oil dispersion | 20 ml |
| Latex dispersion (AE 803, manufactured by Showa Kobunshi Co.) | 22 ml |
| Ethanol | 8 ml |

-continued

| | |
|---|---|
| Pure water to make | 1000 ml |
| (Third Layer Coating Composition) | |
| Silica Dispersion D2 | 630 ml |
| 10 percent aqueous solution of polyvinyl alcohol (PVA 203, manufactured by Kuraray Co., Ltd.) | 5 ml |
| 6.5 percent aqueous solution of polyvinyl alcohol (having an average degree of polymerization of 3,800 and a saponification ratio of 88 percent) | 270 ml |
| Oil dispersion | 10 ml |
| Latex dispersion (AE 803, manufactured by Showa Kobunshi Co.) | 5 ml |
| Ethanol | 3 ml |
| Pure water to make | 1000 ml |
| (Fourth Layer Coating Composition: Uppermost Layer) | |
| Silica Dispersion D2 | 660 ml |
| 10 percent aqueous solution of polyvinyl alcohol (PVA 203, manufactured by Kuraray Co., Ltd.) | 5 ml |
| 6.5 percent aqueous solution of polyvinyl alcohol (having an average degree of polymerization of 3,800 and a saponification ratio of 88 percent) | 250 ml |
| 4 percent aqueous solution of Betaine Type Surface Active Agent 1 | 3 ml |
| 25 percent aqueous saponin solution | 2 ml |
| Ethanol | 3 ml |
| Pure water to make | 1000 ml |

Betaine Type Surface Active Agent 1

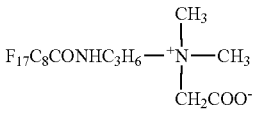

Each coating composition, prepared as above, was filtered through a TCPD-30 Filter having a filtration accuracy of 20 μm, manufactured by Advantech Toyo Co. and subsequently filtered through a TCPD-10 Filter.

Table 1 shows the physical property values of each coating composition prepared as above.

TABLE 1

| Characteristic Value | First Layer | Second Layer | Third Layer | Fourth Layer |
|---|---|---|---|---|
| Viscosity (at 40° C.) mPa · s | 50 | 65 | 65 | 81 |
| Viscosity (at 15° C.) mPa · s | 19,000 | >20,000 | >20,000 | >20,000 |
| Surface tension (at 25° C.) μN/cm | 370 | 380 | 390 | 310 |
| pH | 4.6 | 4.5 | 4.2 | 4.1 |

Subsequently, four layers were simultaneously applied at 40° C. onto a paper substrate of which both sides were laminated with polyethylene, employing a slide hopper type coater so that each of said coating compositions resulted in the wet layer thickness described below.

<Wet Layer Thickness>
First Layer: 42 μm
Second Layer: 39 μm
Third Layer: 44 μm
Fourth Layer: 38 μm Incidentally, employed as said paper substrate was a 1.5 m wide and approximately 4,000 m long substrate wound into a roll. Said paper substrate was prepared as described below.

Polyethylene comprising 6 percent of anatase type titanium oxide was extruded at a thickness of 35 μm and melt-coated onto the surface of a 170 g/m$^2$ photographic base paper, having a water content of 8 percent, while polyethylene was extruded at a thickness of 40 μm and melt-coated onto the opposite surface. The surface was subjected to corona discharge and subsequently, coated with a sublayer so that the coated weight of polyvinyl alcohol (PVA 235, manufactured by Kuraray Co.) was 0.05 g per m$^2$ of the recording sheet. The opposite surface was subjected to a corona discharge treatment and was coated with a backing layer comprising approximately 0.4 g of a styrene-acrylic acid ester based latex binder having a Tg of approximately 80° C., 0.1 g of an antistatic agent (being a cationic polymer), and 0.1 g of approximately 2 μm silica as a matting agent.

After coating said ink receptive layer coating composition, the resultant coating was passed through a cooling period maintained at 5° C. for 15 seconds so as to lower the temperature of the coating surface to 13° C. Subsequently, the resultant coating was dried by being passed through each of several periods in which air at the temperatures described below was successively blown over the image receptive layer and subsequently wound into a roll, whereby Comparative Recording Sheet 1 was prepared. Incidentally, the average relative humidity of each of the blown air was no more than 30 percent. However, the tenth period was a rehumidifying period, having a relative humidity of 40 to 60 percent.

First period: 30° C. for 30 seconds
Second period: 45° C. for 30 seconds
Third period: 60° C. for 30 seconds
Fourth period: 60° C. for 30 seconds
Fifth period: 60° C. for 30 seconds
Sixth period: 60° C. for 30 seconds
Seventh period: 60° C. for 30 seconds
Eighth period: 60° C. for 30 seconds
Ninth period: 40° C. for 30 seconds
Tenth period: 25° C. for 90 seconds The void volume of Recording Sheet 1, prepared as above, was 23 ml per m$^2$ of said recording sheet.

The temperature of the resultant layer surface was determined. As a result, it was found that the constant drying rate periods included the first to the fifth period, falling drying rate periods started from the second half of the sixth period, and the drying termination point (at which the surface temperature equaled the temperature of the blown air) was located in the eighth period. Incidentally, the water content (based on that void volume of 23 ml/m$^2$ was designated as 100) at the exit of each period was as follows.

Fifth period: 210
Sixth period: 120
Seventh period: 50
Eighth period: 0

Said Recording Sheet 1 was temporarily wound into a roll and stored at 23° C. for 4 hours. Thereafter, 3 percent boric acid solution was overcoated, employing a spray coater, so as to obtain a wet layer thickness of 10 μm (corresponding to approximately 43 percent of the void volume), and the resultant coating was dried for one minute, employing a 40° C. airflow, whereby Recording Sheet 2 was prepared. The viscosity of said aqueous solution was approximately 1 mP·s at room temperature, and the surface tension thereof was from about 600 to about 700 μN/cm. Comparative Recording Sheets 3 and 4 were prepared in the same manner as Recording Sheet 2, except that the storage period was varied to one day and 7 days at 23° C.

Resultant Recording Sheets 1 through 4 were stabilized upon being stored at 40° C. for one week.

(Evaluation of Characteristics of Recording Sheets)

Each of the recording sheets prepared as above was subjected to evaluation of the void volume, the layer surface unevenness, the ink absorbability, the image uniformity, and the color formation, based on the methods described below.

<Determination of the Void Volume>

The ink absorption amount during a contact time of two seconds was determined as the void volume, employing a Bristow Tester Type II (pressure system).

<Evaluation of the Layer Surface Unevenness>

Solid neutral gray, having a reflection density of approximately 1.0, was printed employing an ink-jet printer PM 770C, manufactured by Seiko Epson Co. Subsequently, the presence or absence of any unevenness was visually evaluated into 5 ranks, based on the criteria described below.

1: no unevenness was noticed
2: slight unevenness was noticed, however, at a commercially viable level, even though solid images were printed
3: unevenness was clearly noticed on printed solid images, however was at a level which resulted in almost no problem for commercially prepared prints
4: unevenness of gray was noticed and was at a commercially unviable level
5: not at a commercially viable level.

In the above evaluation ranking, 4 as well 5 indicates that products are not commercially viable.

<Evaluation of Ink Absorbability>

An ink transfer amount (in ml/m$^2$) during a contact time of 0.2 second was determined as a measure of ink absorbability, employing a Bristow Tester Type II (pressure system), manufactured by Kumagai Riki Kogyo Co., Ltd. Incidentally, during said determination, a water based ink, comprising 1 percent of a magenta dye, 15 percent of diethylene glycol, and 15 percent of glycerin, was used.

<Evaluation of Image Uniformity>

Each of the blue, green, and red reflection densities of the print, prepared for evaluation of said unevenness of the layer surface, was determined at 20 positions, that is 5 positions in the width direction by 4 positions in the longitudinal direction. The image uniformity was evaluated based on the formula described below:

$$\text{image uniformity}=[(\sigma b/Db)^2+(\sigma g/Dg)^2+(\sigma r/Dr)^2]^{1/2}$$

Wherein Db, Dg, and Dr each represent the average of blue, green and red reflection density, and σb, σg, and σr each represent the standard deviation of reflection density of each respective color. The smaller the numerical value, the higher the density uniformity becomes.

<Evaluation of Color Forming Properties>

Solid black images were printed employing the same printer used for the evaluation of said unevenness of the layer surface, and subsequently, the resulting maximum reflection density was determined.

Table 2 shows the obtained results.

Incidentally, (A) and (B) described in Table 2 are detailed as follows.

(A): volume of water incorporated in the coating during overcoating/void volume (B): volume of the overcoating composition/void volume

TABLE 2

| Recording Sheet | | | | Void Volume (in | Unevenness Ranking of Layer | Ink | | Maximum Density | | | |
|---|---|---|---|---|---|---|---|---|---|---|---|
| No. | (A) | (B) | (A) + (B) | ml/m$^2$) | Surface | Absorbability | Uniformity | B | G | R | Remarks |
| 5 | — | — | — | 23 | 1 | 6.3 | 0.009 | 1.90 | 2.21 | 2.36 | Comp. |
| 6 | 0 | 0.43 | 0.43 | 23 | 1 | 14.2 | 0.015 | 1.90 | 2.24 | 2.27 | Comp. |
| 7 | 0 | 0.43 | 0.43 | 23 | 1 | 13.5 | 0.036 | 1.94 | 2.25 | 2.28 | Comp. |
| 8 | 0 | 0.43 | 0.43 | 23 | 2 | 13.8 | 0.049 | 1.92 | 2.22 | 2.31 | Comp. |

Comp.: Comparative Example

As can clearly be seen from the results in Table 2, compared to Recording Sheet 1, Recording Sheets 2 through 4 resulted in a marked increase in the absorption rate by overcoating boric acid, but the unevenness of the layer surface slightly increased depending upon the storage period before overcoating, and the uniformity of prints was degraded.

Example 2

(Preparation of Recording Sheets 5 through 8)

Recording Sheets 5 through 8 were prepared in such a manner that in Recording Sheet 1 prepared in Example 1, during drying the ink receptive layer, the 3 percent aqueous boric acid solution which was the same as that of Example 1 was overcoated onto Recording Sheet 1 at each of the fifth, sixth, seventh, and eighth exits, employing a spray coater so as to obtain a wet layer thickness of 10 μm. The drying conditions in each period was the same and at the exit of the ninth period, drying was perfectly completed.

(Preparation Recording Sheets 5A through 8A)

Recording Sheets 5A through 8A were prepared in the same manner as said Recording Sheets 5 through 8, except that the 3 percent aqueous boric acid solution was replaced with a 2 percent solution and the wet layer thickness was changed from 10 μm to 15 μm (approximately 0.65 time the void volume).

(Preparation of Recording Sheet 5B through 8B)

Recording Sheets 5B through 8B were prepared in the same manner as said Recording Sheets 5 through 8, except that the 3 percent aqueous boric acid solution was replaced with a 1.5 percent solution and the wet layer thickness was changed from 10 μm to 20 μm (approximately 0.87 time the void volume).

(Preparation of Recording Sheet 5C through 8C)

Recording Sheets 5C through 8C were prepared in the same manner as said Recording Sheets 5 through 8, except that the 3 percent aqueous boric acid solution was replaced with a 1.2 percent solution and the wet layer thickness was changed from 10 μm to 25 μm (approximately 1.09 times the void volume).

(Preparation of Recording Sheet 5D through 8D)

Recording Sheets 5D through 8D were prepared in the same manner as said Recording Sheets 5 through 8, except that the 3 percent aqueous boric acid solution was replaced with a 1 percent solution and the wet layer thickness was changed from 10 μm to 30 μm (approximately 1.3 times the void volume).

(Preparation of Recording Sheets 5E through 8E)

Recording Sheets 5E through 8E were prepared in the same manner as said Recording Sheets 5 through 8, except that the 3 percent aqueous boric acid solution was replaced with a 0.75 percent solution and the wet layer thickness was changed from 10 μm to 40 μm (approximately 1.74 times the void volume).

After coating, each sample, prepared as above, was stored at 40° C. for one week, and each characteristic was evaluated in the same manners as Example 1. Table 3 shows the obtained results.

TABLE 3

| Recording Sheet | | | | Void Volume (in | Unevenness Ranking of Layer | Ink | | Maximum Density | | | |
|---|---|---|---|---|---|---|---|---|---|---|---|
| No. | (A) | (B) | (A) + (B) | ml/m$^2$) | Surface | Absorbability | Uniformity | B | G | R | Remarks |
| 5 | 2.1 | 0.43 | 2.53 | 23 | 5 | 14.4 | 0.112 | 1.85 | 2.14 | 2.15 | Comp. |
| 6 | 1.2 | 0.43 | 1.63 | 23 | 4 | 13.9 | 0.053 | 1.90 | 2.20 | 2.19 | Comp. |
| 7 | 0.5 | 0.43 | 0.93 | 23 | 1 | 13.7 | 0.013 | 1.92 | 2.28 | 2.24 | Inv. |
| 8 | 0 | 0.43 | 0.43 | 23 | 1 | 14.1 | 0.013 | 1.91 | 2.23 | 2.29 | Inv. |
| 5A | 2.1 | 0.65 | 2.75 | 23 | 5 | 14.3 | 0.127 | 1.82 | 2.11 | 2.13 | Comp. |
| 6A | 1.2 | 0.65 | 1.85 | 23 | 4 | 14.5 | 0.061 | 1.89 | 2.18 | 2.20 | Comp. |
| 7A | 0.5 | 0.65 | 1.15 | 23 | 1 | 14.6 | 0.017 | 1.92 | 2.26 | 2.22 | Inv. |
| 8A | 0 | 0.65 | 0.65 | 23 | 1 | 14.2 | 0.015 | 1.91 | 2.23 | 2.30 | Inv. |
| 5B | 2.1 | 0.87 | 2.97 | 23 | 5 | 13.6 | 0.132 | 1.78 | 2.02 | 2.06 | Comp. |
| 6B | 1.2 | 0.87 | 2.07 | 23 | 4 | 13.6 | 0.079 | 1.82 | 2.11 | 2.12 | Comp. |
| 7B | 0.5 | 0.87 | 1.37 | 23 | 2 | 14.3 | 0.019 | 1.89 | 2.19 | 2.22 | Inv. |
| 8B | 0 | 0.87 | 0.87 | 23 | 1 | 14.7 | 0.014 | 1.93 | 2.20 | 2.26 | Inv. |
| 5C | 2.1 | 1.09 | 3.19 | 23 | 5 | 13.7 | 0.144 | 1.72 | 2.00 | 2.09 | Comp. |
| 6C | 1.2 | 1.09 | 2.29 | 23 | 4 | 14.5 | 0.088 | 1.81 | 2.05 | 2.17 | Comp. |
| 7C | 0.5 | 1.09 | 1.59 | 23 | 3 | 14.2 | 0.031 | 1.88 | 2.19 | 2.21 | Inv. |
| 8C | 0 | 1.09 | 1.09 | 23 | 1 | 14.0 | 0.022 | 1.94 | 2.21 | 2.24 | Inv. |
| 5D | 2.1 | 1.30 | 3.40 | 23 | 5 | 14.5 | 0.157 | 1.67 | 1.96 | 2.01 | Comp. |
| 6D | 1.2 | 1.30 | 2.50 | 23 | 5 | 14.1 | 0.091 | 1.78 | 2.05 | 2.11 | Comp. |
| 7D | 0.5 | 1.30 | 1.80 | 23 | 3 | 13.9 | 0.038 | 1.84 | 2.09 | 2.21 | Inv. |
| 8D | 0 | 1.30 | 1.30 | 23 | 2 | 14.0 | 0.033 | 1.90 | 2.16 | 2.27 | Inv. |
| 5E | 2.1 | 1.74 | 3.84 | 23 | 5 | 14.2 | 0.154 | 1.61 | 1.88 | 1.92 | Comp. |
| 6E | 1.2 | 1.74 | 2.94 | 23 | 5 | 14.8 | 0.112 | 1.70 | 1.92 | 2.02 | Comp. |
| 7E | 0.5 | 1.74 | 2.24 | 23 | 3 | 14.1 | 0.044 | 1.80 | 2.03 | 2.11 | Inv. |
| 8E | 0 | 1.74 | 1.74 | 23 | 3 | 14.6 | 0.034 | 1.90 | 2.14 | 2.20 | Inv. |

Inv.: Present Invention,

Comp.: Comparative Example

As can clearly be seen from the results in Table 3, with regard to Recording Sheets 5, 5A through 5E, 6, and 6A through 6E, even when overcoating is carried out at any wet layer thickness, the unevenness of the layer surface was so great as to be beyond the commercially viable range. On the contrary, with regard to Recording Sheets 7, 7A through 7E, 8, and 8A through 8E of the present invention, in which overcoating was carried out after the volume of water incorporated in the coating became less than the void volume, the unevenness of any of the layer surfaces was within the commercially viable range, even though there was a difference in the relationship among the volume of water incorporated in the coating, the total volume of the overcoat composition, and the void volume. Specifically, when the total volume of the overcoat composition was no more than 1.5 times the void volume, the unevenness of the layer surface was minimized, and when said factor was no more than 1.2 times, the unevenness of the layer surface was optimally minimized.

Any of the resultant ink absorbability equaled at of Recording Sheets 2 through 4 and exhibited a high ink absorption rate.

Furthermore, Recording Sheets 7, 7A through 7E, 8, and 8A through 8E resulted in no problems with the color forming properties and the uniformity because they were almost similar to ones at the period prior to the overcoating. However, the uniformity of Recording Sheets 5, 5A through 5E, 6, and 6A through 6E was markedly degraded due to the unevenness of the layer surface, and further, the color forming properties were slightly degraded. It is estimated that this was due to the microscopic localization of boric acid.

Example 3

Recording Sheets 5F through 8F and 5G through 8G were prepared in the same manner as Recording Sheets 5 through 8 and 5B through 8B in Example 2, except that the temperature of the drying airflow in the third to eighth periods was raised to 65° C.

Incidentally, the initial position of the falling drying rate was varied from the sixth period to the fourth period, and the water content ratio at the exit of each period was as follows:

Fifth period: 140

Sixth period: 40

Seventh period: 0

Eighth period: 0

Each characteristic of Recording Sheets 5F through 8F and 5G through 8G, prepared as above, was evaluated employing the same method as Example 1. Table 4 shows the obtained results.

TABLE 4

| Recording Sheet | Overcoat Drying | | | | Void Volume (in | Unevenness Ranking of Layer | Ink | | Maximum Density | | | |
|---|---|---|---|---|---|---|---|---|---|---|---|---|
| No. | Zone | (A) | (B) | (A) + (B) | ml/m$^2$) | Surface | Absorbability | Uniformity | B | G | R | Remarks |
| 5F | 5th zone | 1.4 | 0.43 | 1.83 | 23 | 4 | 14.8 | 0.063 | 1.89 | 2.20 | 2.21 | Comp. |
| 6F | 6th zone | 0.4 | 0.43 | 0.83 | 23 | 1 | 14.2 | 0.015 | 1.90 | 2.22 | 2.29 | Inv. |
| 7F | 7th zone | 0 | 0.43 | 0.43 | 23 | 1 | 14.5 | 0.011 | 1.92 | 2.28 | 2.304 | Inv. |
| 8F | 8th zone | 0 | 0.43 | 0.43 | 23 | 1 | 14.5 | 0.012 | 1.92 | 2.25 | 2.29 | Inv. |
| 5G | 5th zone | 1.4 | 0.87 | 2.27 | 23 | 4 | 14.2 | 0.052 | 1.84 | 2.12 | 2.19 | Comp. |
| 6G | 6th zone | 0.4 | 0.87 | 1.27 | 23 | 1 | 14.1 | 0.022 | 1.88 | 2.20 | 2.22 | Inv. |
| 7G | 7th zone | 0 | 0.87 | 0.87 | 23 | 1 | 14.0 | 0.013 | 1.90 | 2.21 | 2.26 | Inv. |
| 8G | 8th zone | 0 | 0.87 | 0.87 | 23 | 1 | 13.9 | 0.013 | 1.93 | 2.22 | 2.28 | Inv. |

Inv.: Present Invention,
Comp.: Comparative Example

As can clearly be seen from the results in Table 4, the recording sheets of the present invention, in which the overcoating was carried out so that the volume of water incorporated in the coating was no more than the void volume, resulted in a uniform layer surface and exhibited excellent uniformity as well as high ink absorbability being identical to which the results obtained in Example 2.

Example 4

(Preparation of Recording Sheets 8H through 8S)

Recording Sheets 8H through 8S were prepared in the same manner as Recording Sheet 8 prepared in Example 2, except that each of the water content ratios of the base paper of the paper substrate, laminated with polyethylene, was varied as shown in Table 5, and further, each of the concentrations of the aqueous boric acid solution, used for the overcoat, as well as the wet layer thickness was varied as shown in Table 5. However, said aqueous boric acid solution was overcoated at the end of the tenth period as a rehumidifying period, and the resultant coating was not substantially dried. Said coating was wound into a roll approximately 10 seconds after said overcoating, and was stored at 23° C. for one week without any treatment.

(Evaluation of Recording Sheets 8H through 8S)

Recording Sheets 8H through 8S, prepared as above, were evaluated for ink absorbability, employing the method described in Example 1, as well as for curling in accordance with the method described below. Table 5 shows the obtained results.

<Evaluation of Curling>

Said curling was evaluated as follows. Each of the wound samples was cut into A4 size sheets. Each part of the resultant sheets was left on a horizontal plate for one hour or one day at each of conditions of relative humidity of 20 percent, 55 percent, and 80 percent at 20° C. Subsequently, the height of rise at each of the four corners was measured. The average of the four-corner values was designated as curling (in mm units). Incidentally, each recording sheet was placed on its side so that the four corners rose. When the surface of the ink absorptive layer was placed upward, the rise at four corners was shown as + curling, while when said surface was placed downward, said rise was shown as − curling.

TABLE 5

| Recording Sheet No. | Water Content Ratio of Base Paper (in %) | Boric Acid Concentration (in %) | Wet Layer Thickness (in μm) | Ink Absorbability | Curling (in mm) 55% RH 1 hour | 55% RH 1 day | 20% RH 1 hour | 20% RH 1 day | 80% RH 1 hour | 80% RH 1 day | Remarks |
|---|---|---|---|---|---|---|---|---|---|---|---|
| 8H | 9.5 | 1.5 | 13.3 | 18.3 | +46 | +19 | +3 | +8 | −1 | −2 | Inv. |
| 8I | 9.5 | 2.0 | 10.0 | 17.5 | +37 | +16 | +4 | +6 | −2 | −3 | Inv. |
| 8J | 9.5 | 4.0 | 5.0 | 18.1 | +28 | +15 | +3 | +7 | −2 | −2 | Inv. |
| 8K | 8.0 | 1.5 | 13.3 | 17.7 | +26 | +16 | +2 | +6 | −2 | −2 | Inv. |
| 8L | 8.0 | 2.0 | 10.0 | 18.3 | +19 | +14 | +3 | +7 | −2 | −2 | Inv. |
| 8M | 8.0 | 4.0 | 5.0 | 17.6 | +14 | +11 | +3 | +5 | −3 | −3 | Inv. |
| 8N | 6.0 | 1.5 | 13.3 | 17.9 | +18 | +13 | +4 | +5 | −4 | −2 | Inv. |
| 8O | 6.0 | 2.0 | 10.0 | 18.2 | +17 | +13 | +3 | +4 | −5 | −3 | Inv. |
| 8P | 6.0 | 4.0 | 5.0 | 18.1 | +16 | +12 | +3 | +4 | −4 | −3 | Inv. |
| 8Q | 4.0 | 1.5 | 13.3 | 17.8 | +10 | +13 | +3 | +5 | −5 | −3 | Inv. |
| 8R | 4.0 | 2.0 | 10.0 | 18.2 | +11 | +12 | +2 | +5 | −6 | −4 | Inv. |
| 8S | 4.0 | 4.0 | 5.0 | 18.1 | +9 | +13 | +4 | +5 | −6 | −4 | Inv. |

Inv.: Present Invention

As can clearly be seen from the results in Table 5, the recording sheets which had been overcoated with the aqueous boric acid solution, wound without having been basically dried, and subsequently stored at room temperature for one week, resulted in further improved ink absorbability compared to Recording Sheet 8, used as the standard. However, when said recording sheets were left in a variety of humidity environments immediately after cutting, curling occurred due to the fact that drying was not substantially carried out. When the water content ratio of base paper of the substrate was 9.5 percent, large + curling occurred immediately after being placed in a low humidity condition. The water content ratio of said base paper is preferably no more than 8 percent. Further, it was confirmed that when the water content ratio was no more than 6 percent, curling was minimized.

Further, even under said states, it was found that when recording sheets are left over an extended period of time, curling decreased due to the fact that water content in the paper was equilibrated with the ambient moisture.

The amount of the overcoat composition is preferably no more than 10 ml/m$^2$. It was possible to confirm that said amount was 5.7 percent with respect to the base paper.

Example 5

(Preparation of Recording Sheets 11 through 11C and 12 through 12C).

Recording Sheets 11 and 12 were prepared in the same manner as Recording Sheet 1 prepared in Example 1, except that the added amount (in g/m$^2$) of Betaine Type Surface Active Agent 1 used in the fourth layer was altered as shown in Table 6.

Subsequently, Recording Sheets 11A and 12A were prepared in such a manner that during the preparation of Recording Sheet 1 described in Example 1, an aqueous Betaine Type Surface Active Agent 1, of which concentration had been suitably adjusted, was overcoated so as to obtain a wet layer thickness of 8 μm.

In addition, Recording Sheets 11B and 12B were prepared in the same manner as Recording Sheet 1 prepared in Example 1, except that an aqueous Betaine Type Surface Active Agent 1 solution, of which concentration had been suitably adjusted, was overcoated so as to obtain a wet layer thickness of 8 μm one day after coating the ink receptive layer, while Recording Sheets 11C and 12C were prepared in the same manner as Recording Sheet 1, except that said Surface Active Agent 1 solution was overcoated one hour after coating the same.

(Evaluation of Characteristics of Recording Sheets)

Cracking during coating, as well as the dot diameter of Recording Sheets, prepared as above, was determined based on the standards described below.

<Evaluation of Cracking>

The number of cracks formed per m$^2$ of each recording sheet was determined and cracking was represented by the resultant number.

<Measurement of Dot Diameter>

Cyan dots were printed employing the same ink-jet printer used in Example 1. The resultant dots were magnified employing a microscope with a built-in CCD camera, and the diameter (in μm) of ten dots was determined and the average was calculated. Incidentally, the dot diameter was obtained as the diameter of dots which were assumed to be a sphere.

Table 6 shows the results obtained as above.

Incidentally, the abbreviated addition methods used in Table 6 refer to the following.

CS: Betaine Type Surface Active Agent 1 was added to the coating composition.

OLOC: the aqueous Betaine Type Surface Active Agent 1 solution was overcoated utilizing a on-line means.

OFOC1: after setting Recording Sheet 1 aside for one day, the aqueous Betaine Type Surface Active Agent 1 solution was overcoated.

OFOC7: after keeping Recording Sheet 1 for 7 days, the aqueous Betaine Type Surface Active Agent 1 solution was overcoated.

TABLE 6

| | Surface Active Agent | | | | |
|---|---|---|---|---|---|
| Recording Sheet No. | Addition Method | Added Amount (in g/m$^2$) | Number of Cracks | Dot Diameter (in μm) | Remarks |
| 1 | CS | 0.0046 | 0 | 54 | Comparative Example |
| 11 | CS | 0.012 | 12 | 58 | Comparative Example |
| 12 | CS | 0.036 | 80 | 61 | Comparative Example |
| 11A | OLOC | 0.012 | 0 | 57 | Present Invention |
| 12A | OLOC | 0.036 | 0 | 61 | Present Invention |
| 11B | OFOC1 | 0.012 | 0 | 59 | Comparative Example |
| 12B | OFOC1 | 0.036 | 0 | 63 | Comparative Example |
| 11C | OFOC7 | 0.012 | 0 | 61 | Comparative Example |
| 12C | OFOC7 | 0.036 | 0 | 66 | Comparative Example |

As can clearly be seen from the results in Table 6, when the amount of the betaine type surface active agent was increased, the dot diameter increased in all cases. On the other hand, in the Comparative Examples in which said surface active agent was previously added, the number of cracks increased. Contrary to this, in the overcoated recording sheets of the present invention, it was found that it was possible to increase the dot diameter without increasing the number of cracks. However, when after coating the ink receptive layer, overcoating was carried out after storage of a definite period, the dot diameter tended to gradually increase during storage. This trend suggests that during production, insufficient management of the time, until overcoating, results in a great variation of color reproduction due to the variation of the dot diameter.

Example 6

Recording Sheets 21 through 26 were prepared in the same manner as Recording Sheet 8 prepared in Example 2, except that carboxymethyl cellulose was added to the aqueous boric acid solution in an amount ranging from 0.001 to 0.1 percent and the viscosity of the overcoat composition was adjusted to the values described in Table 7 below Each of the obtained recording sheets was evaluated for enevenness of the layer surface as well as the uniformity, employing the methods described in Example 1. Table 7 shows the obtained results.

TABLE 7

| Recording Sheet No. | Viscosity of Overcoat Composition (in mPa · s) | Unevenness Ranking of Layer Surface | Uniformity | Remarks |
|---|---|---|---|---|
| 21 | 1.95 | 1 | 0.009 | Present Invention |
| 22 | 4.8 | 1 | 0.011 | Present Invention |
| 23 | 16.9 | 1 | 0.015 | Present Invention |
| 24 | 26.3 | 2 | 0.026 | Present Invention |
| 25 | 83 | 2 | 0.034 | Present Invention |
| 26 | 112 | 3 | 0.048 | Present Invention |

As can clearly be seen from Table 7, systems in which the overcoat composition had a viscosity of no more 100 mpa·s resulted in minimized unevenness of the layer surface as well as excellent uniformity, and the recording-sheets overcoated with an overcoat composition, having a viscosity of no more than 20 mPa·s exhibited markedly minimal unevenness of the layer surface as well as excellent uniformity.

Example 7

Recording Sheets 31 through 41 were prepared in the same manner as Recording Sheet 1 prepared in Example 1, except that Anti-Discoloring Agent 1 or 2 was added to the first layer and also the second layer in the amount described in Table 7. Incidentally, said anti-discoloring agents were dissolved in a solvent mixture consisting of water and ethanol and added to each coating composition.

Anti-Discoloring Agent 1: $(HOC_2H_4—S—CH_2)_2—$

Anti-Discoloring Agent 2: $HO—N(C_2H_4SO_3Na)_2$

On the other hand, Recording Sheets 31A and 41A were prepared in the same manner as Recording Sheet 1 prepared in Example 1, except that at the exit of the eighth period, each aqueous solution of said Anti-Discoloring Agent 1 or 2 was overcoated so as to obtain a wet layer thickness of 10 μm at a coating amount of 0.4 g/m$^2$.

Further, Recording Sheets 31B, 31C, 41B, and 41C were prepared in the same manner as Recording Sheet 1 prepared in Example 1, except that each of said anti-discoloring agent solutions was overcoated 1 day and 7 days after coating the ink receptive layer.

Each of the recording sheets prepared as above was evaluated for cracking during coating, employing the method described in Example 5, as well as discoloring properties and the uniformity of the coating surface before and after the discoloring treatment, based on the methods described below.

Said discoloring properties were determined as follows. A cyan wedge image was printed. Subsequently, a portion having a density of 1.0 was determined. After the print was set aside while exposed to an external airflow for one month, the density of said portion was measured, and the retained density ratio with respect to the initial density was determined. Further, with regard to recording sheets immediately after printing as well as recording sheets whose printed surface was continuously exposed to an external airflow for one month, said uniformity of the coating surface was evaluated, employing the same method described in Example 1.

Table 8 shows the results obtained as above.

Incidentally, abbreviations of coating methods described in Table 8 refer to the following.

CS: an anti-discoloring agent was added to the coating composition.

OLOC: an anti-discoloring agent solution was overcoated utilizing a on-line means.

OFOC1: a recording sheet was stored for one day, and an anti-discoloring agent solution was then overcoated.

OFOC7: a recording sheet was stored for 7 days, and an anti-discoloring agent solution was then overcoated.

Further, Recording Sheets 51B and 51C were prepared in the same manner as for Recording Sheet 1, except that said aqueous citric acid solution was overcoated in the same manner as for Recording Sheet 51, after one-day storage and 7-day storage, after coating of the ink receptive layer.

Each recording sheet, prepared as above, as well as Recording Sheet 1, prepared in Example 1, was evaluated for cracking and uniformity, employing the methods described in said examples, and in addition, evaluated for waterfastness, employing the method described below. Table 9 shows the obtained results.

TABLE 8

| | Anti-Discoloring | | | | Uniformity | | | |
|---|---|---|---|---|---|---|---|---|
| Recording Sheet No. | Type | Added Amount (in g/m$^2$) | Coating Method | Number of Formed Cracks | Immediately after Coating | After Discoloring Treatment | Discoloring Properties | Remarks |
| 1 | — | — | — | 0 | 0.009 | 0.032 | 0.62 | Comparative Example |
| 31 | 1 | 0.4 | CS | 25 | 0.022 | 0.036 | 0.93 | Comparative Example |
| 31A | 1 | 0.4 | OLOC | 0 | 0.020 | 0.041 | 0.94 | Present Invention |
| 31B | 1 | 0.4 | OFOC1 | 0 | 0.039 | 0.087 | 0.94 | Comparative Example |
| 31C | 1 | 0.4 | OFOC7 | 0 | 0.051 | 0.102 | 0.93 | Comparative Example |
| 41 | 2 | 0.4 | CS | 69 | 0.030 | 0.042 | 0.88 | Comparative Example |
| 41A | 2 | 0.4 | OLOC | 0 | 0.031 | 0.045 | 0.89 | Present Invention |
| 41B | 2 | 0.4 | OFOC1 | 0 | 0.051 | 0.103 | 0.89 | Comparative Example |
| 41C | 2 | 0.4 | OFOC7 | 0 | 0.072 | 0.136 | 0.87 | Comparative Example |

As can clearly be seen from Table 8, Recording Sheets 31A and 41A, which had been overcoated with Anti-Discoloring Agent 1 or 2, exhibited improved discoloring properties without increasing the number of formed cracks as well as without degrading the uniformity. On the contrary, Recording Sheets 31 and 41, in which each anti-discoloring agent had been added to the coating composition, resulted in an increase in the number of formed cracks. Further, when overcoating was carried out after storage, the uniformity is particularly degraded not only immediately after printing but also after the discoloring treatment.

Example 8

Recording Sheet 51 was prepared in the same manner as Recording Sheet 1 prepared in Example 1, except that each coating composition was prepared under conditions in which citric acid was added to the silica dispersion and the pH of the coating composition was decreased to 0.5. During this operation, the viscosity, at 40° C., of each coating composition did not vary greatly. However, the viscosity at 15° C. decreased by ⅓ to ⅕. As a result, unevenness of the layer surface was slightly noticeable due to non-uniform coating of the coating composition.

Subsequently, Recording Sheet 51A was prepared in the same manner as Recording Sheet 8 prepared in Example 2, except that at the exit of the eighth period, an aqueous citric acid solution was overcoated instead of the aqueous boric acid solution.

<Evaluation of Waterfastness>

Each of said prepared prints was immersed in pure water for one minute, and subsequently, allowed to dry naturally. The degree of dye flow (the degree of bleeding) was visually evaluated based on the criteria listed below.

A: no traces of bleeding were noticed

B: slight bleeding traces were noticed

C: bleeding traces were evident.

TABLE 9

| Recording Sheet No. | Citric Acid Addition Method | Number of Formed Cracks | Uniformity | Waterfastness Rank | Remarks |
|---|---|---|---|---|---|
| 1 | — | 0 | 0.009 | B | Comparative Example |
| 51 | CS | 100 or more | 0.044 | A | Comparative Example |
| 51A | OLOC | 0 | 0.025 | A | Present Invention |
| 51B | OFOC1 | 0 | 0.066 | A | Comparative Example |
| 51C | OFOC7 | 0 | 0.112 | A | Comparative Example |

As can clearly be seen from Table 9, Recording Sheet 51 A, which had been overcoated with citric acid utilizing an on-line means, exhibited a lower number of formed cracks and better uniformity, and in addition, improved waterfastness, compared to Recording Sheet 51 which had been prepared by adding said citric acid to the coating composition.

Example 9

Each of said coating compositions was prepared in conditions such that the aqueous citric acid solution employed to prepare each of said coating compositions to prepare Recording Sheet 51, described in Example 8, was replaced with an aqueous triethanolamine (TEA) solution, and the pH of each was raised by 1.0. The viscosity, at 40° C., of each of the prepared coating compositions resulted in an increase by a factor of 3 to 5. Therefore, the resulting coating surface resulted in slight streaked unevenness. Recording Sheet 61 was prepared in the same manner as Recording Sheet 51 prepared in Example 8, except that said coating composition was employed.

On the other hand, Recording Sheets 61A through 61C were prepared in the same manner as Recording Sheets 51A through 51C prepared in Example 8, except that citric acid was replaced with TEA and the pH was increased.

Each of the recording sheets, prepared as above, was evaluated for cracking as well as uniformity, employing the same methods described in said example, and in addition, evaluated far lightfastness based on the method described below.

<Evaluation of Lightfastness>

Said lightfastness was evaluated as follows. A magenta wedge image was printed. Subsequently, a portion having a density of 1.0 was determined. After the print was exposed to sunlight through window glass for one month, the density of said portion after exposure was measured, and the retained density ratio with respect to the initial density was determined.

Table 10 shows the evaluation results of each item, obtained as above.

TABLE 10

| Recording Sheet No. | TEA Addition Method | Number of Formed Cracks | Uniformity | Light-fastness | Remarks |
|---|---|---|---|---|---|
| 1 | — | 0 | 0.009 | 0.52 | Comparative Example |
| 61 | CS | 30 | 0.044 | 0.71 | Comparative Example |
| 61A | OLOC | 0 | 0.015 | 0.73 | Present Invention |
| 61B | OFOC1 | 0 | 0.056 | 0.72 | Comparative Example |
| 61C | OFOC7 | 0 | 0.093 | 0.73 | Comparative Example |

As can clearly be seen from Table 10, it was confirmed that it was possible to improve the lightfastness of Recording Sheet 61A, which had been overcoated with TEA, without increasing the number of cracks as well as without degrading the uniformity, compared to the comparative samples.

Example 10

Recording Sheets 71 through 74 were prepared in the same manner as Recording Sheet 1 described in Example 1, except that each of the multivalent metal containing solutions, described in Table 11, was added to the fourth layer so as to obtain a coating weight of said metal compound of 0.1 g/m$^2$. However, all the coating compositions, prepared as above, were subjected to coagulation, whereby many minute cracks were formed on the layer surface.

Subsequently, Recording Sheets 71A through 74A were prepared in the same manner as Recording Sheet 8 prepared in Example 2, except that the aqueous boric acid solution was replaced with each of the multivalent metal containing solutions described in Table 11.

Subsequently, Recording Sheets 71B through 74B and 71C through 74C were prepared in the same manner as Recording Sheet 1, except that each of said aqueous multivalent metal containing solutions was overcoated in the same manner as Recording Sheet 71A, after one-day storage and 7-day storage after coating the ink receptive layer.

Each of the recording sheets, prepared as above, and Recording Sheet 1, prepared in Example 1, were evaluated for cracking, uniformity, and lightfastness, employing the same methods described in said example, and in addition, for bleeding based on the method described below.

(Evaluation of Bleeding)

Said bleeding was evaluated as follows. An approximately 0.4 mm wide magenta line was printed. After storing the resulting print at 40° C. and 80 percent relative humidity for 2 days, an increase (in μm) in the line width was determined as the amount of said bleeding.

Table 11 shows the results of each item obtained as above.

Incidentally, the abbreviation for each multivalent metal compound, described in Table 11, represents the following.

AL-1: $Al_2(SO_4)_3$

AL-2: polyaluminum hydroxide (Paho#2S, manufactured by Asada Kagaku Kogyou Co.)

MG-1: $Mg_2SO_4$

ZR-1: zirconyl acetate (ZA-30, manufactured by Daiichi Kigenso Kokyo Co.)

TABLE 11

| Recording Sheet No. | Multivalent Metal Compound Type | Multivalent Metal Compound Addition Method | Number of Formed Cracks | Uniformity | Light-fastness | Bleeding | Remarks |
|---|---|---|---|---|---|---|---|
| 1 | — | | 0 | 0.009 | 0.52 | 55 | Comp. |
| 71 | AL-1 | CS | 100 or more | 0.032 | 0.58 | 21 | Comp. |
| 71A | AL-1 | OLOC | 0 | 0.017 | 0.59 | 20 | Inv. |
| 71B | AL-1 | OFOC1 | 0 | 0.032 | 0.58 | 22 | Comp. |

TABLE 11-continued

| Recording Sheet No. | Multivalent Metal Compound Type | Multivalent Metal Compound Addition Method | Number of Formed Cracks | Uniformity | Light-fastness | Bleeding | Remarks |
|---|---|---|---|---|---|---|---|
| 71C | AL-1 | OFOC7 | 0 | 0.054 | 0.59 | 24 | Comp. |
| 72 | AL-2 | CS | 100 or more | 0.023 | 0.52 | 27 | Comp. |
| 72A | AL-2 | OLOC | 0 | 0.014 | 0.52 | 25 | Inv. |
| 72B | AL-2 | OFOC1 | 0 | 0.042 | 0.51 | 24 | Comp. |
| 72C | AL-2 | OFOC7 | 0 | 0.071 | 0.52 | 25 | Comp. |
| 73 | MG-1 | CS | 62 | 0.039 | 0.74 | 62 | Comp. |
| 73A | MG-1 | OLOC | 0 | 0.013 | 0.72 | 63 | Inv. |
| 73B | MG-1 | OFOC1 | 0 | 0.051 | 0.73 | 62 | Comp. |
| 73C | MG-1 | OFOC7 | 0 | 0.092 | 0.71 | 63 | Comp. |
| 74 | ZR-1 | CS | 100 or more | 0.022 | 0.55 | 24 | Comp. |
| 74A | ZR-1 | OLOC | 0 | 0.014 | 0.54 | 23 | Inv. |
| 74B | ZR-1 | OFOC1 | 0 | 0.066 | 0.54 | 23 | Comp. |
| 74C | ZR-1 | OFOC7 | 0 | 0.079 | 0.53 | 22 | Comp. |

Inv.: Present Invention,
Comp.: Comparative Example

As can clearly be seen from Table 11, regarding Recording Sheets 71A through 74A, it was possible to improve the lightfastness as well as to minimize the bleeding without increasing cracks as well as without degrading the uniformity.

It is possible to provide a high quality ink-jet recording sheet, having a porous layer, which results in very little cracking during production, decreases fluctuation in manufacturing quality, and improves the coating uniformity through the incorporation of each of the functional additives, employing an overcoating method.

What is claimed is:

1. A method for preparing an ink-jet recording sheet, comprising the steps of:

(a) coating on, a substrate, an aqueous coating composition containing a hydrophilic binder and inorganic particles to form a porous layer having a surface;

(b) drying the porous layer over a period, wherein the period comprises at least a constant drying rate period defined by a drying period over which the surface of the porous layer has a temperature that remains constant and a falling drying rate period defined by a drying period over which the surface of the porous layer has a temperature which rises; and (c) incorporating a solution containing an additive selected from the group consisting of a surface active agent, a hardener for the hydrophilic binder, an image stabilizer, a water-soluble polyvalent metal compound, a pH moderator and a cationic fixing agent, into the porous layer after the completion of the constant drying rate period in the same coating line used for coating the aqueous coating composition to form the porous layer.

2. The method for preparing the ink-jet recording sheet of claim 1, wherein the incorporation of the solution containing an additive on the porous layer is carried out at the moment when the following formula is satisfied:

$$Vwp+Vs \leqq 1.5\ Vvp,$$

wherein Vwp is the volume content of water in the porous layer, Vs is the volume of the solution containing an additive and Vvp is the void volume of the porous layer at a drying end point.

3. The method for preparing the ink-jet recording sheet of claim 1, wherein the solution containing an additive comprises water or a mixture of water and an organic solvent which is miscible with water.

4. The method for preparing the ink-jet recording sheet of claim 1, wherein the ink-jet recording sheet is wound in a roll after the step (c) without substantially drying.

5. The method for preparing the ink-jet recording sheet of claim 1, wherein the substrate is a resin coated paper comprising paper covered with a polyolefin resin on both sides of the paper.

6. The method for preparing the ink-jet recording sheet of claim 5, wherein the content of water in the paper is at most 8 weight % of the paper.

7. The method for preparing the ink-jet recording sheet of claim 5, wherein the incorporation of the solution containing an additive on the porous layer is carried out at the moment when the following formula is satisfied:

$$Mwp+Mws \leqq 0.07\ Mp,$$

wherein Mwp is the weight content of water in the porous layer Mws is the weight content of water in the solution containing an additive, and Mp is the weight of the paper used for the substrate.

8. The method for preparing the ink-jet recording sheet of claim 1, wherein the additive in the solution is the surface active agent.

9. The method for preparing the ink-jet recording sheet of claim 1, wherein the viscosity of the solution containing the additive is at most 100 mPa·s.

10. The method for preparing the ink-jet recording sheet of claim 1, wherein the additive of the solution is the hardener for the hydrophilic binder.

11. The method for preparing the ink-jet recording sheet of claim 1, wherein the additive in the solution is the image stabilizer.

12. The method for preparing the ink-jet recording sheet of claim 1, wherein the additive in the solution is the water-soluble polyvalent metal compound.

13. The method for preparing the ink-jet recording sheet of claim 1, wherein the pH value of the solution containing the additive is from 1 to 5.

14. The method for preparing the ink-jet recording sheet of claim 1, wherein the pH value of the solution containing the additive is from 8 to 13.

15. A method for preparing an ink-jet recording sheet, comprising the steps of:

(a) coating, on a substrate, an aqueous coating composition containing a hydrophilic binder and inorganic particles to form a porous layer having a surface;

(b) drying the porous layer over a period, wherein the period comprises at least a constant drying rate period defined by a drying period over which the surface of the porous layer has a temperature that remains constant and a falling drying rate period defined by a drying period over which the surface of the porous layer has a temperature which rises; and (c) incorporating a solution containing an additive selected from the group consisting of a surface active agent, a hardener for the hydrophilic binder, an image stabilizer, a water-soluble polyvalent metal compound, a pH moderator and a cationic fixing agent, into the porous layer after the completion of the constant drying rate period and before the completion of the falling drying rate period.

* * * * *